US010598055B2

(12) United States Patent
Kataoka et al.

(10) Patent No.: US 10,598,055 B2
(45) Date of Patent: Mar. 24, 2020

(54) VARIABLE VALVE OPERATING APPARATUS

(71) Applicant: HONDA MOTOR CO., LTD., Tokyo (JP)

(72) Inventors: Dai Kataoka, Wako (JP); Yoshihiro Takada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/023,469

(22) Filed: Jun. 29, 2018

(65) Prior Publication Data

US 2019/0003351 A1 Jan. 3, 2019

(30) Foreign Application Priority Data

Jun. 30, 2017 (JP) ..... 2017-128364

(51) Int. Cl.
*F01L 13/00* (2006.01)
*F01L 1/053* (2006.01)
(Continued)

(52) U.S. Cl.
CPC ..... *F01L 13/0036* (2013.01); *F01L 1/026* (2013.01); *F01L 1/053* (2013.01); *F02F 7/0021* (2013.01);
(Continued)

(58) Field of Classification Search
CPC ..... F01L 13/0036; F01L 1/026; F01L 1/053; F01L 2001/0537; F01L 2013/105;
(Continued)

(56) References Cited

U.S. PATENT DOCUMENTS 5,623,897 A * 4/1997 Hampton ..... F01L 1/185 123/198 F
2014/0303873 A1* 10/2014 Glugla ..... F01L 13/0036 701/103

FOREIGN PATENT DOCUMENTS

DE 102007061353 A1 * 6/2009 ..... F01L 13/0036
DE 102011076726 A1 * 12/2012 ..... F01L 1/047
(Continued)

OTHER PUBLICATIONS

DE-102007061353 english language machine translation.*

*Primary Examiner* — Patrick Hamo
*Assistant Examiner* — Wesley G Harris
(74) *Attorney, Agent, or Firm* — Birch, Stewart, Kolasch & Birch, LLP

(57) ABSTRACT

An engine variable valve operating apparatus includes a cam switching mechanism having a switching drive shaft. When the switching drive shaft is longitudinally moved, a cam mechanism advances and retracts a switching pin. When the switching pin is advanced to engage in a lead groove formed around a cam carrier and the cam carrier is axially moved while rotating, cam lobes around the cam carrier are switched to act on an engine valve. An actuator for the switching drive shaft includes an actuator drive body which is linearly reciprocally movable and is coupled to a longitudinal end of the switching drive shaft to axially move the same. The above arrangement enables the cam switching mechanism and the actuator mechanism to be simple and compact in structure for preventing the engine from becoming large in size.

13 Claims, 11 Drawing Sheets

(51) Int. Cl.
*F02F 7/00* (2006.01)
*F01L 1/02* (2006.01)
*F01L 1/047* (2006.01)

(52) U.S. Cl.
CPC ..... *F01L 1/022* (2013.01); *F01L 2001/0473* (2013.01); *F01L 2001/0537* (2013.01); *F01L 2013/0052* (2013.01); *F01L 2013/105* (2013.01); *F01L 2250/02* (2013.01); *F02F 2007/0041* (2013.01)

(58) Field of Classification Search
CPC ..... F01L 2013/0052; F01L 1/022; F01L 2250/02; F01L 2001/0473; F02F 7/0021; F02F 2007/0041
USPC ..... 123/90.16, 90.18
See application file for complete search history.

(56) References Cited

FOREIGN PATENT DOCUMENTS

| | | | | |
|---|---|---|---|---|
| EP | 0356162 A1 * | 2/1990 | ..... | F01L 1/34406 |
| JP | 2014-134165 A | 7/2014 | | |

* cited by examiner

VARIABLE VALVE OPERATING APPARATUS

TECHNICAL FIELD

The present invention relates to a variable valve operating apparatus that switches the operating characteristics of the intake and exhaust valves of an internal combustion engine.

BACKGROUND ART

There have been known variable valve operating apparatuses for use in internal combustion engines, including a cam switching mechanism in which a cam carrier has a plurality of cam lobes formed on the outer circumferential surface thereof and having different cam profiles that determine valve operating characteristics. The cam carrier is relatively non-rotatably and axially slidably fitted over a camshaft, and is axially moved to cause different cam lobes to act on engine valves to switch the valve operating characteristics (see, for example, Patent Document 1).

PRIOR ART DOCUMENT

Patent Document

[Patent Document 1]
JP 2014-134165 A

According to the variable valve operating apparatus disclosed in Patent Document 1, the cam carrier that is slidably fitted over the camshaft which is rotatably supported in the cylinder head has a guide groove (lead groove) defined fully circumferentially therein, and switching pins engage in the guide groove to guide and move the cam carrier axially while the cam carrier is rotating, thereby switching cam lobes that operate the engine valves.

In the cam switching mechanism of the disclosed valve operating apparatus, the guide groove is formed between a pair of side wall surfaces that face each other and serve individually as first and second switching cams, and the switching pins include first and second switching pins for contact with the first and second switching cams, respectively. When the first switching pin projects into contact with the first switching cam, it axially moves the cam carrier into a first position in which a first cam lobe acts on the engine valve, and when the second switching pin projects into contact with the second switching cam, it axially moves the cam carrier into a second position in which a second cam lobe acts on the engine valve.

The valve operating apparatus includes a hydraulic pressure circuit for applying a hydraulic pressure to respective ends of the first and second switching pins to move the first and second switching pins alternately back and forth, i.e., to advance and retract the first and second switching pins alternately.

The first switching pin is movably disposed in a pin slot whose upper portion is held in fluid communication with a first oil channel that is held in fluid communication with an axially elongate first oil gallery. Similarly, the second switching pin is movably disposed in a pin slot whose upper portion is held in fluid communication with a second oil channel that is held in fluid communication with an axially elongate second oil gallery.

SUMMARY OF THE INVENTION

Problems to be Solved by the Invention

Since the cam switching mechanism disclosed in Patent Document 1 actuates the first and second switching pins by applying a hydraulic pressure thereto, the hydraulic pressure circuit including the pin slots, the oil channels, the oil galleries, etc. needs to be positioned near the first and second switching pins. According to Patent Document 1, the hydraulic pressure circuit is provided in a cylinder head cover disposed above the cam carrier.

It is not easy and hence is costly to machine the cylinder head cover to incorporate complex structural details of the hydraulic pressure circuit therein.

Inasmuch as the cylinder head cover needs to be large enough to include the hydraulic pressure circuit therein, it necessarily makes the internal combustion engine large in size. Therefore, seeking a space in a vehicle to install the internal combustion engine therein is an important problem to be fulfilled.

The present invention has been made in view of the above problems. It is an object of the present invention to provide a variable valve operating apparatus including cam switching mechanisms and a drive mechanism for driving the cam switching mechanisms, the cam switching mechanisms and the drive mechanism being simple and compact in structure for preventing an internal combustion engine that incorporates the variable valve operating apparatus from becoming large in size.

Means for Solving the Problems

In order to achieve the above object, there is provided in accordance with the present invention a variable valve operating apparatus comprising: a camshaft rotatably mounted in a cylinder head superposed on a cylinder block of an internal combustion engine; a cam carrier in the form a hollow cylindrical member relatively non-rotatably and axially slidably fitted around the camshaft and including, on an outer circumferential surface thereof, a plurality of cam lobes having different cam profiles and disposed axially adjacent to each other; and a cam switching mechanism for axially moving the cam carrier to switch the cam lobes to act on an engine valve;

wherein the cam switching mechanism includes: a lead groove formed in an outer circumferential surface of the cam carrier and extending fully circumferentially therearound; a switching pin capable of being advanced to engage in and retracted to disengage from the lead groove; a switching drive shaft disposed parallel to the camshaft to be movable longitudinally thereof so as to cooperate with the switching pin to constitute a cam mechanism for advancing and retracting movements of the switching pin, in such a manner that the advancing movement causes the switching pin to engage in the lead groove so as to axially move the cam carrier while rotating, to switch the cam lobes to act on the engine valve; and an actuator for longitudinally moving the switching drive shaft, the actuator including an actuator drive body which is linearly reciprocally movable and is coupled to a longitudinal end of the switching drive shaft for longitudinally moving the switching drive shaft.

With the above arrangement, since the switching drive shaft parallel to the camshaft as it is actuated causes the cam mechanism to advance and retract the switching pin, the cam switching mechanism is of a simple structure made up of a reduced number of parts, and the drive mechanism for axially moving the switching drive shaft of the cam switching mechanism is of a simple compact structure in which the actuator drive body of the actuator is coupled to the end of the switching drive shaft. Consequently, the internal combustion engine is prevented from being large in size and is low in cost.

In the above arrangement, the actuator may be formed integrally with the cylinder head.

With the above arrangement, as the actuator is formed integrally with the cylinder head, the number of parts used is reduced, and the actuator can be incorporated in a compact layout in the internal combustion engine.

In the above arrangement, the actuator may be a hydraulic pressure actuator reciprocally moving the actuator drive body under hydraulic pressure.

With the above arrangement, since the hydraulic pressure actuator for reciprocally moving the actuator drive body under hydraulic pressure is used, the hydraulic pressure actuator which is of a small size can be mounted on the end of the switching drive shaft of the cam switching mechanism, so that the engine is prevented from being large in size and the switching drive shaft can be moved with good responsiveness under hydraulic pressure.

In the above arrangement, the variable valve operating apparatus may further include another switching drive shaft and another hydraulic pressure actuator, each of the switching drive shafts being associated individually with each of the switching drive shafts.

With the above arrangement, inasmuch as the hydraulic pressure actuators are provided individually on the switching drive shafts, the individual hydraulic pressure actuators can be reduced in size and the switching drive shafts can individually be moved quickly.

The variable valve operating apparatus may further comprise two hydraulic liquid supply and discharge channels for supplying hydraulic liquid to and discharging the hydraulic liquid from one of the hydraulic pressure actuators, wherein the other hydraulic pressure actuator may be placed in the hydraulic liquid supply and discharge channels, in such a manner that hydraulic liquid flows through the other hydraulic pressure actuator before acting on the one hydraulic pressure actuator.

With the above arrangement, the other hydraulic pressure actuator is placed in the hydraulic liquid supply and discharge channels that supply hydraulic liquid under pressure to and discharge hydraulic liquid from the one hydraulic pressure actuator, so that hydraulic liquid under pressure flows through the other hydraulic pressure actuator before acting on the one hydraulic pressure actuator. Consequently, the hydraulic liquid supply and discharge channels are shared by the hydraulic pressure actuators. The hydraulic liquid supply and discharge channels are thus made smaller and disposed in a more compact layout than if the hydraulic liquid supply and discharge channels are independently provided for the hydraulic pressure actuators, with the result that the internal combustion engine is prevented from being large in size.

In the above arrangement, each of the hydraulic pressure actuators may include an actuator housing having an inner housing chamber, with the actuator drive body being reciprocally slidably fitted therein; and the inner housing chamber is divided into two hydraulic pressure chambers by the actuator drive body, the hydraulic liquid supply and discharge channels being held in fluid communication with each of the two hydraulic pressure chambers.

With the above arrangement, the hydraulic liquid supply and discharge channels are held in fluid communication with the two hydraulic pressure chambers that are formed by dividing the inner housing chamber in the actuator housing with the actuator drive body. Therefore, the two hydraulic liquid supply and discharge channels can be disposed in a compact layout parallel to the directions in which the actuator drive body moves, making it possible to prevent the internal combustion engine from being large in size.

In the above arrangement, the inner housing chamber may be defined as a round hole; and the actuator drive body may have a bottomed hollow cylindrical shape and include an elongate hole defined in a hollow cylindrical portion thereof and held in fluid communication with the hydraulic liquid supply and discharge channels, the elongate hole being elongate in directions in which the actuator drive body is movable.

With the above arrangement, the actuator drive body that is reciprocally movable in the inner housing chamber defined as a round hole is of a bottomed hollow cylindrical shape. The elongate hole is defined in the hollow cylindrical portion in fluid communication with the hydraulic liquid supply and discharge channel, and is elongate in the directions in which the actuator drive body moves. Consequently, even when the actuator drive body is moved, the fluid communication port of the hydraulic liquid supply and discharge channel which is defined in the actuator housing and open into the inner housing chamber faces the elongate hole in the hollow cylindrical portion at all times, always keeping the oil supply and discharge channel and the hydraulic pressure chamber in fluid communication with each other.

In the above arrangement, the camshaft may be rotatable by drive power transmitted from the internal combustion engine through a cam chain; and the actuator is disposed opposite a cam chain compartment which houses the cam chain therein, in the axial directions of the camshaft.

With the above arrangement, as the actuator is disposed opposite the cam chain compartment that houses therein the cam chain for transmitting drive power from the internal combustion engine to the camshaft, in the axial directions of the camshaft, the actuator is kept out of interference with the cam chain, etc., but disposed in an optimum place where it can easily be installed and which is not obstructed by the cam chain compartment.

In the above arrangement, the internal combustion engine may include a crankcase, the cylinder block and the cylinder head integrally fastened to the crankcase by stud bolts oriented in axial directions of a cylinder in the cylinder block; and the actuator may be disposed so as to be at least partly superposed on axial extensions of the stud bolts.

With the above arrangement, the actuator is disposed so as to be at least partly superposed on axial extensions of the stud bolts by which the cylinder block and the cylinder head are stacked on and fastened to the crankcase. Consequently, either actuator or the stud bolts can be placed without protruding outward from the cylinder head, thus preventing the internal combustion engine from being large in size.

In the above arrangement, the internal combustion engine may include the crankcase, the cylinder block and the cylinder head integrally fastened to the crankcase by the stud bolts oriented in axial directions of the cylinder in the cylinder block; and the switching drive shaft and the switching pin may be disposed so as to be at least partly superposed on axial extensions of the stud bolts.

With the above arrangement, the switching drive shaft and the switching pin are disposed so as to be at least partly superposed on axial extensions of the stud bolts by which the cylinder block and the cylinder head are stacked on and fastened to the crankcase. Consequently, either the switching drive shaft and the switching pin or the stud bolts can be placed without protruding outward from the cylinder head, thus preventing the internal combustion engine from being large in size.

In the above arrangement, the cylinder head may be separable in axial directions of the cylinder in the cylinder block into a first cylinder head member mounted on the cylinder block and a second cylinder head member mounted on the first cylinder head member; the engine valve may be supported on the first cylinder head member; and the camshaft may be rotatably supported by bearings on the second cylinder head member.

With the above arrangement, the cylinder head, which is separable along the cylinder axes, includes the first cylinder head member mounted on the cylinder block and the second cylinder head member mounted on the first cylinder head member. The valves are supported on the first cylinder head member, whereas the camshaft is supported by bearings on the second cylinder head member. Therefore, the camshaft and the cam switching mechanism, other than the engine valves that are supported on the first cylinder head member, are provided on the separate second cylinder head member. The first cylinder head member and the second cylinder head member are thus simplified in structure, and can be manufactured with ease.

Effects of the Invention

According to the present invention, the cam switching mechanism includes the switching drive shaft that is engaged by the switching pin through the cam mechanism, and the switching drive shaft as it is actuated causes the cam mechanism to advance and retract the switching pin. The cam switching mechanism is of a simple structure made up of a reduced number of parts, and the drive mechanism for axially moving the switching drive shaft of the cam switching mechanism is of a simple compact structure in which the actuator drive body of the actuator is coupled to the end of the switching drive shaft. Consequently, the internal combustion engine is prevented from being large in size and is low in cost.

MODE FOR CARRYING OUT THE INVENTION

A variable valve operating apparatus according to an embodiment of the present invention will be described below with reference to the drawings.

Figure 1:
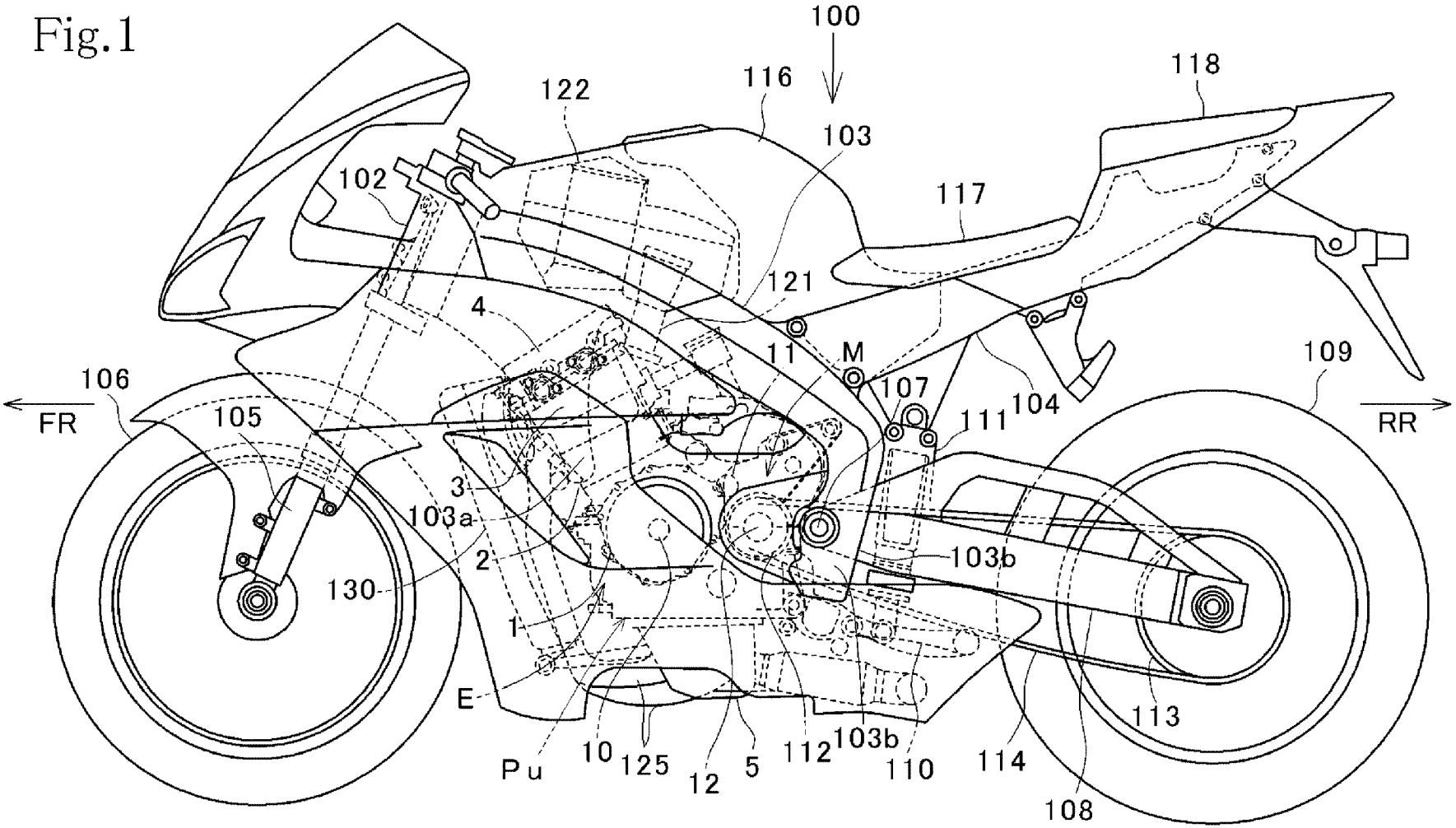
FIG. 1 is a side elevational view of a motorcycle that includes an internal combustion engine incorporating therein a variable valve operating apparatus according to an embodiment of the present invention.

FIG. 1 is a side elevational view of a motorcycle 100 as a saddle-type vehicle that includes an internal combustion engine incorporating therein the variable valve operating apparatus according to the embodiment of the present invention.

In the present description and the claims, directions such as forward, rearward, leftward, and rightward and other similar directional expressions are in accordance with ordinary directional standards on the motorcycle 100 according to the present embodiment where the direction in which the motorcycle 100 moves straight ahead is referred to as the forward direction. In the accompanying drawings, FR represents the forward direction, RR the rearward direction, LH the leftward direction, and RH the rightward direction.

The motorcycle 100 has a vehicle body frame including a head pipe 102 by which there is steerably supported a front fork 105 with a front wheel 106 rotatably supported thereon by a front axle, and a pair of left and right main frames 103 extending rearward and obliquely downward from the head pipe 102.

The main frames 103 have front portions from which engine hangers 103*a* are suspended downward and rear portions bent downward from which pivot frames 103*b* extend downward.

Seat rails 104 are coupled to and extend rearward from respective central rear portions of the main frames 103.

A swing arm 108 extends rearward from a front end thereof that is pivotally supported on the pivot frames 103*b* by a pivot shaft 107, and has a rear end on which a rear wheel 109 is rotatably supported by a rear axle.

A link mechanism 110 is provided between the swing arm 108 and the pivot frames 103*b*, and a rear cushion 111 is interposed between part of the link mechanism 110 and the seat rails 104.

A power unit Pu is suspended between the engine hangers 103*a* and the pivot frames 103*b* of the main frames 103. The power unit Pu includes a transmission M in its rear part which has a countershaft 12 that serves as an output shaft. A drive chain 114 is trained around a drive sprocket 112 fitted over the output shaft of the transmission M and a driven sprocket 113 fitted over the rear axle by which the rear wheel 109 is supported.

The motorcycle 100 includes an air cleaner 122 mounted on front portions of the main frames 103 and a fuel tank 116 mounted on rear portions of the main frames 103. A main seat 117 and a pillion seat 118 are supported on the seat rails 104 behind the fuel tank 116.

The power unit Pu also includes an internal combustion engine E in its front part which includes an in-line four-cylinder water-cooled four-stroke internal combustion engine with its crankshaft 10 extending laterally. The internal combustion engine E is mounted on the vehicle body frame with its cylinders tilted forward at an appropriate angle.

The crankshaft 10 of the internal combustion engine E is oriented widthwise across the vehicle body frame along leftward and rightward directions, and is rotatably supported by a crankcase 1. The transmission M is integrally combined with the crankcase 1 behind the crankshaft 10.

Figure 2:
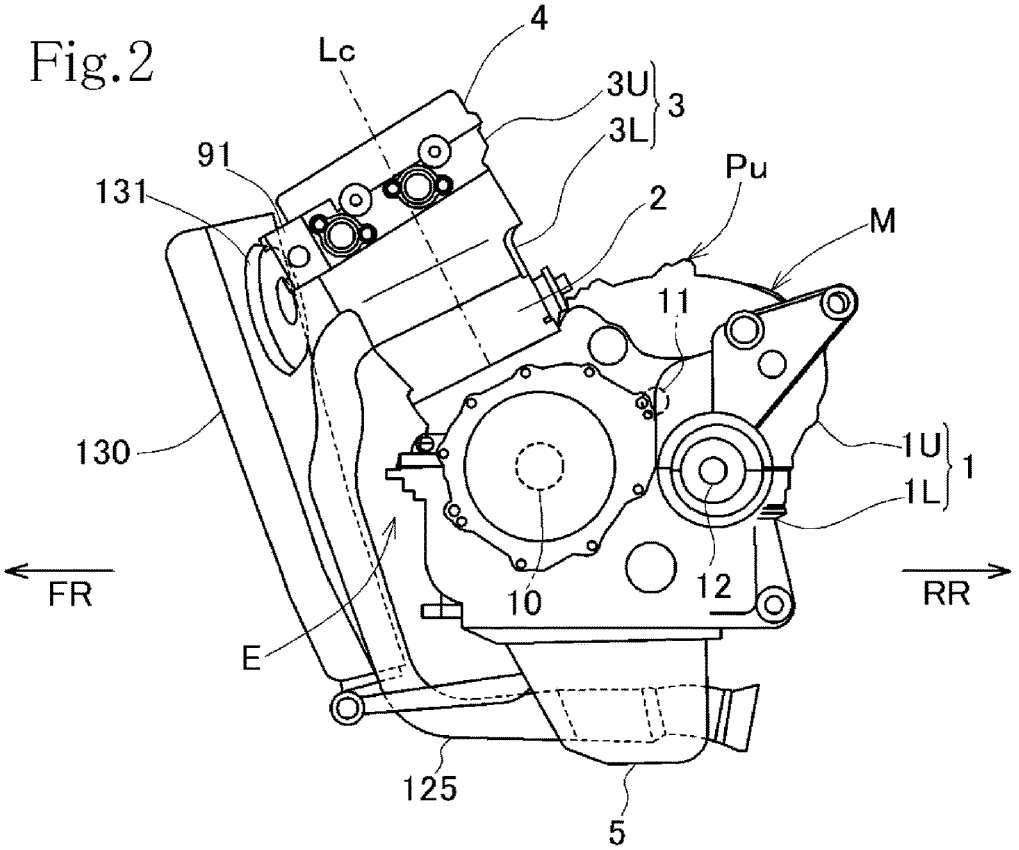
FIG. 2 is a left-hand side elevational view depicting positional relationship between the internal combustion engine and a radiator.

As shown in FIG. 2, the internal combustion engine E includes an engine body including a cylinder block 2 over the crankcase 1 and having four cylinders disposed in line therein, a cylinder head 3 coupled to an upper portion of the cylinder block 2 with a gasket interposed therebetween, and a cylinder head cover 4 covering an upper portion of the cylinder head 3.

The cylinders in the cylinder block 2 have respective cylinder bores defined therein in which respective pistons are slidably disposed. The cylinder bores have respective central axes as cylinder axes Lc that are tilted forward. The cylinder block 2, the cylinder head 3, and the cylinder head cover 4 are successively stacked on and extend upward from the crankcase 1 in a slightly forwardly tilted orientation.

An oil pan 5 is mounted on the lower end of the crankcase 1 and projects downward therefrom.

Figure 3:
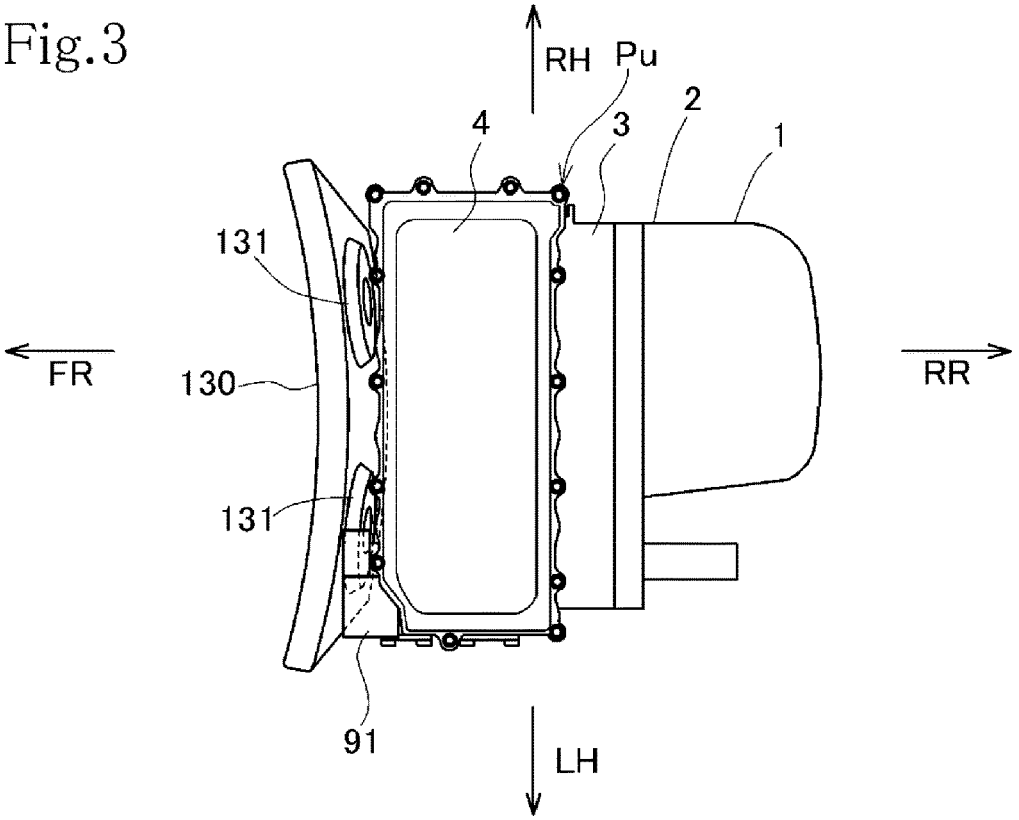
FIG. 3 is a plan view depicting the positional relationship between the internal combustion engine and the radiator.

A radiator 130 is in a curved shape to protrude rearward as depicted in plan in FIG. 3 and disposed closely in front of the engine body of the internal combustion engine E.

As depicted in FIGS. 1 through 3, the radiator 130 is tilted forward along a front surface of the engine body that is tilted slightly forward.

Left and right radiator fans 131 are disposed behind the radiator 130.

The crankcase 1 is of a vertically separable structure including an upper crankcase member 1U and a lower crankcase member 1L that have respective mating surfaces coupled to each other, with the crankshaft 10 being rotatably supported between the mating surfaces.

As shown in FIG. 2, the transmission M is housed in the crankcase 1 behind the crankshaft 10. The transmission M has a main shaft 11 in addition to the countershaft 12, and the main shaft 11 and the countershaft 12 are oriented widthwise across the vehicle body parallel to the crankshaft 10 and rotatably supported by the crankcase 1.

The crankcase 1 has a transmission chamber defined therein in which the main shaft 11 and the countershaft 12 are disposed horizontally in the leftward and rightward directions parallel to the crankshaft 10 (see FIG. 3). The countershaft 12 extends to the left through the crankcase 1 and serves as the output shaft of the transmission M.

As shown in FIG. 1, intake pipes that are associated with the respective cylinders extend from a rear side surface of the cylinder head 23 and are connected to the air cleaner 122 through a throttle body 121.

Exhaust pipes 125 that are associated with the respective cylinders extend downward from a front side surface of the cylinder head 23 and are bent downward and then extend rearward on the right side of the oil pan 5.

Figure 4:
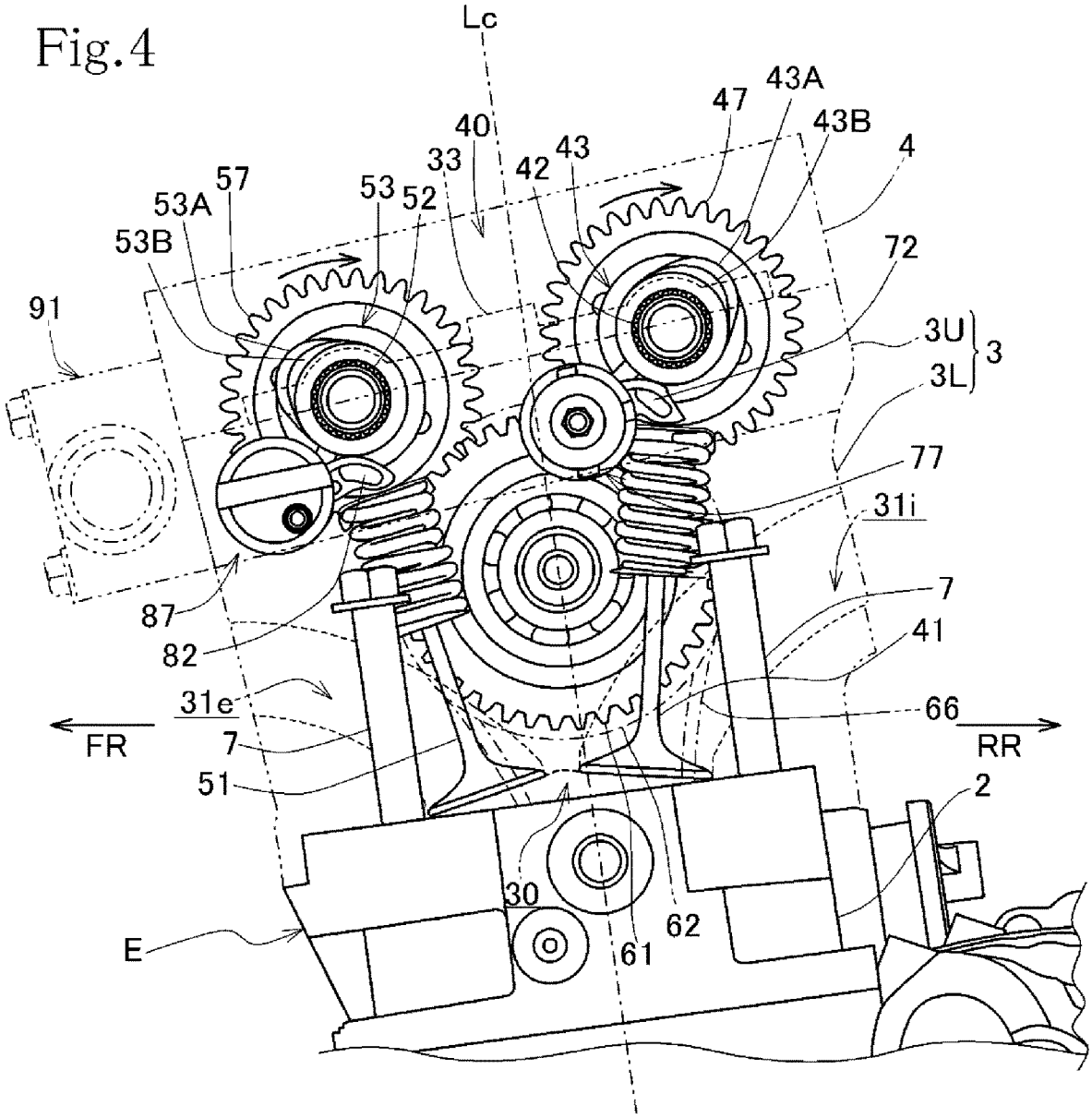
FIG. 4 is a left-hand side elevational view of a valve operating mechanism of the variable valve operating apparatus, indicating profiles of a cylinder head cover, etc. of the internal combustion engine by two-dot-and-dash lines.

As shown in FIG. 4, the internal combustion engine E also includes a four-valve DOHC variable valve operating apparatus 40 disposed in the cylinder head 3.

The cylinder head 3 in the internal combustion engine E, which is vertically separable along the cylinder axes Lc, includes a lower cylinder head member (first cylinder head member) 3L mounted on the cylinder block 2 and an upper cylinder head member (second cylinder head member) 3U mounted on the lower cylinder head member 3L (see FIGS. 2 and 4).

As depicted in FIG. 4, the lower cylinder head member 3L includes two intake ports 31*i* curved rearward and extending upward from a combustion chamber 30 in each of the cylinders, and two exhaust ports 31*e* curved forward and extending from the combustion chamber 30 in each of the cylinders.

The intake ports 31*i* have respective intake valve holes that are open into the combustion chamber 30, and the exhaust ports 31*e* have respective exhaust valve holes that are open into the combustion chamber 30. Two left and right intake valves 41 and two left and right exhaust valves 51 for selectively opening and closing the intake valve holes and the exhaust valve holes are slidably supported in the lower cylinder head member 3L for back-and-forth sliding movement in synchronism with rotation of the crankshaft 10.

Figure 5:
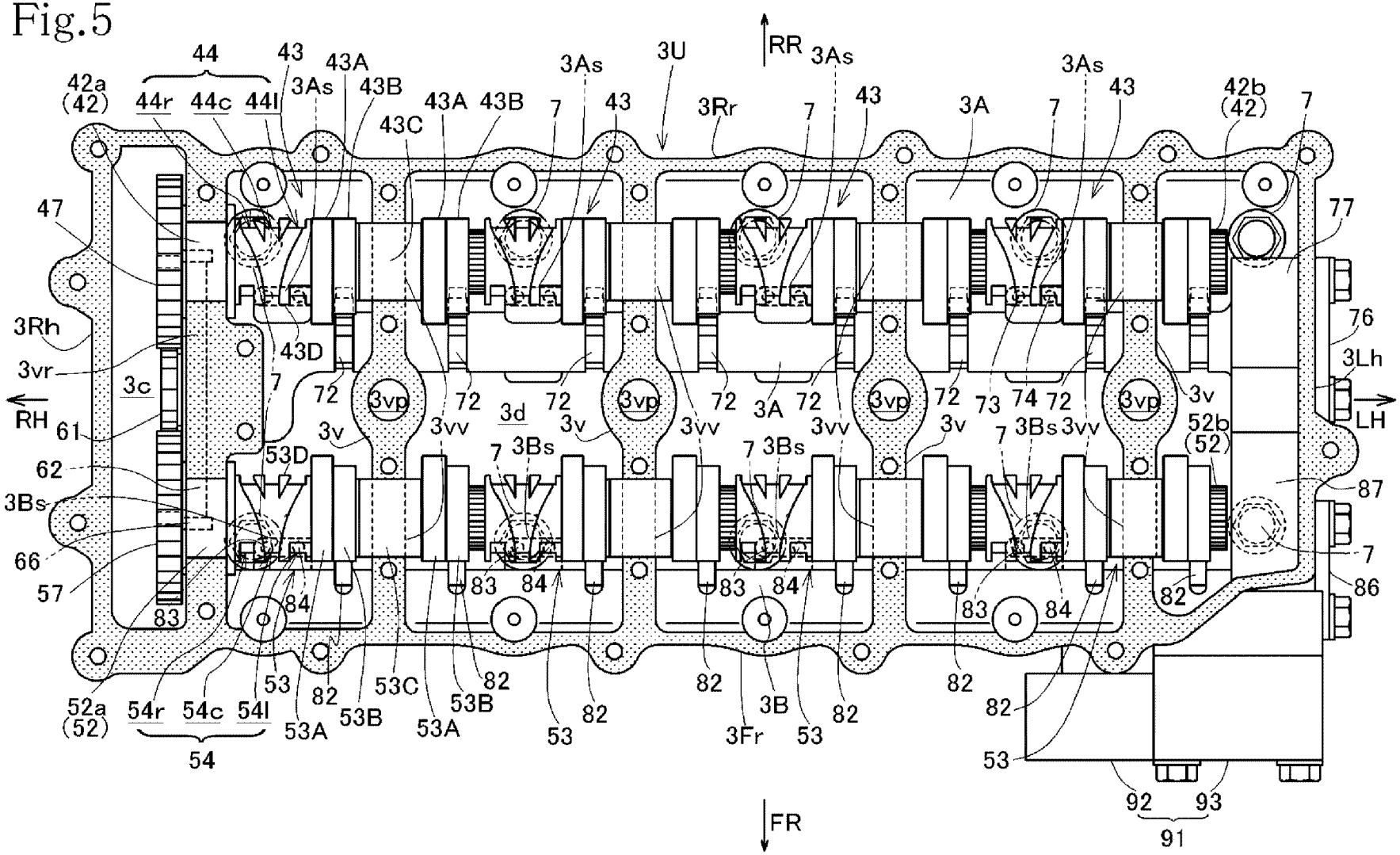
FIG. 5 is a plan view of an upper cylinder head member with the cylinder head cover omitted from illustration.

The lower cylinder head member 3L and the cylinder block 2 are integrally fastened to the upper crankcase member 1U by stud bolts 7 (see FIGS. 4 and 5).

The upper cylinder head member 3U that is mounted on the lower cylinder head member 3L includes a rectangular frame wall assembly which includes, as depicted in FIG. 5, a front side wall 3Fr that is elongated in the leftward and rightward directions, a rear side wall 3Rr that is elongated in the leftward and rightward directions, a left side wall 3Lh that is shorter than the front and rear side walls 3Fr and 3Rr in the forward and rearward directions, and a right side wall 3Rh that is shorter than the front and rear side walls 3Fr and 3Rr in the forward and rearward directions.

The inside space of the rectangular frame wall assembly of the upper cylinder head member 3U is divided into a right narrow cam chain compartment 3*c* and a left valve operating compartment 3*d* by a bearing wall 3*vr* extending parallel to the right side wall 3Rh. The valve operating compartment 3*d* is subdivided into five compartments by four bearing walls 3*v* extending parallel to the left and right side walls 3Lh and 3Rh.

The bearing walls 3*v* are positioned individually above the centers of the combustion chambers 30 in the cylinders, and have plug insertion tubes 3*vp*, individually, on their central areas in the forward and rearward directions for insertion of respective spark plugs therein.

The variable valve operating apparatus 40 is housed in the valve operating compartment 3*d* that is defined by the cylinder head 3 and the cylinder head cover 4.

As depicted in FIGS. 4 and 5, the left and right intake valves 41 that are associated with each of the in-line four cylinders are provided in four pairs in a straight array along the leftward and rightward directions. A single intake camshaft 42 that is oriented in the leftward and rightward directions is disposed in the valve operating compartment 3*d* above the four pairs of the intake valves 41. The intake camshaft 42 is fitted in semi-arcuate bearings 3*vv* in the bearing walls 3*v* and 3*vr* of the upper cylinder head member 3U and sandwiched and rotatably supported by a camshaft holder 33.

Similarly, the left and right exhaust valves 51 that are associated with each of the in-line four cylinders are provided in four pairs in a straight array along the leftward and rightward directions. A single exhaust camshaft 52 that is oriented in the leftward and rightward directions is disposed in the valve operating compartment 3*d* above the four pairs of the exhaust valves 51. The exhaust camshaft 52 is fitted in semi-arcuate bearings 3*vv* in the bearing walls 3*v* and 3*vr* of the upper cylinder head member 3U and sandwiched and rotatably supported by the camshaft holder 33.

The exhaust camshaft 52 is disposed forward of and parallel to the intake camshaft 42.

As depicted in FIG. 5, the intake camshaft 42 includes a journal 42*a* near its right end that is rotatably supported on the bearing wall 3*vr* and is axially positioned by flanges formed on both sides of the journal 42*a* and sandwiching the bearing wall 3*vr* therebetween. The intake camshaft 42 also includes an elongate splined shank 42*b* having external splines on its outer circumferential surface and extending leftward from the journal 42*a* through the four bearing walls 3*v* in the valve operating compartment 3*d*.

An intake driven gear 47 is fitted over the flange on the right end of the intake camshaft 42 which projects into the cam chain compartment 3*c*.

Likewise, the exhaust camshaft 52 includes a journal 52*a* near its right end that is rotatably supported by the bearing wall 3*vr* and is axially positioned by flanges formed on both sides of the journal 52*a* and sandwiching the bearing wall 3*vr* therebetween. The exhaust camshaft 52 also includes an elongate splined shank 52*b* having external splines on its outer circumferential surface and extending leftward from the journal 52*a* through the four bearing walls 3*v* in the valve operating compartment 3*d*.

An exhaust driven gear 57 is fitted over the flange on the right end of the exhaust camshaft 52 which projects into the cam chain compartment 3*c*.

Four intake cam carriers 43 in the form of hollow cylindrical members are arrayed on and splined to the splined shank 42*b* of the intake camshaft 42.

The four intake cam carriers 43 are relatively non-rotatably and axially slidably fitted over the intake camshaft 42.

Similarly, four exhaust cam carriers 53 in the form of hollow cylindrical members are arrayed on and splined to the splined shank 52*b* of the exhaust camshaft 52, and are relatively non-rotatably and axially slidably fitted over the exhaust camshaft 52.

Figure 6:
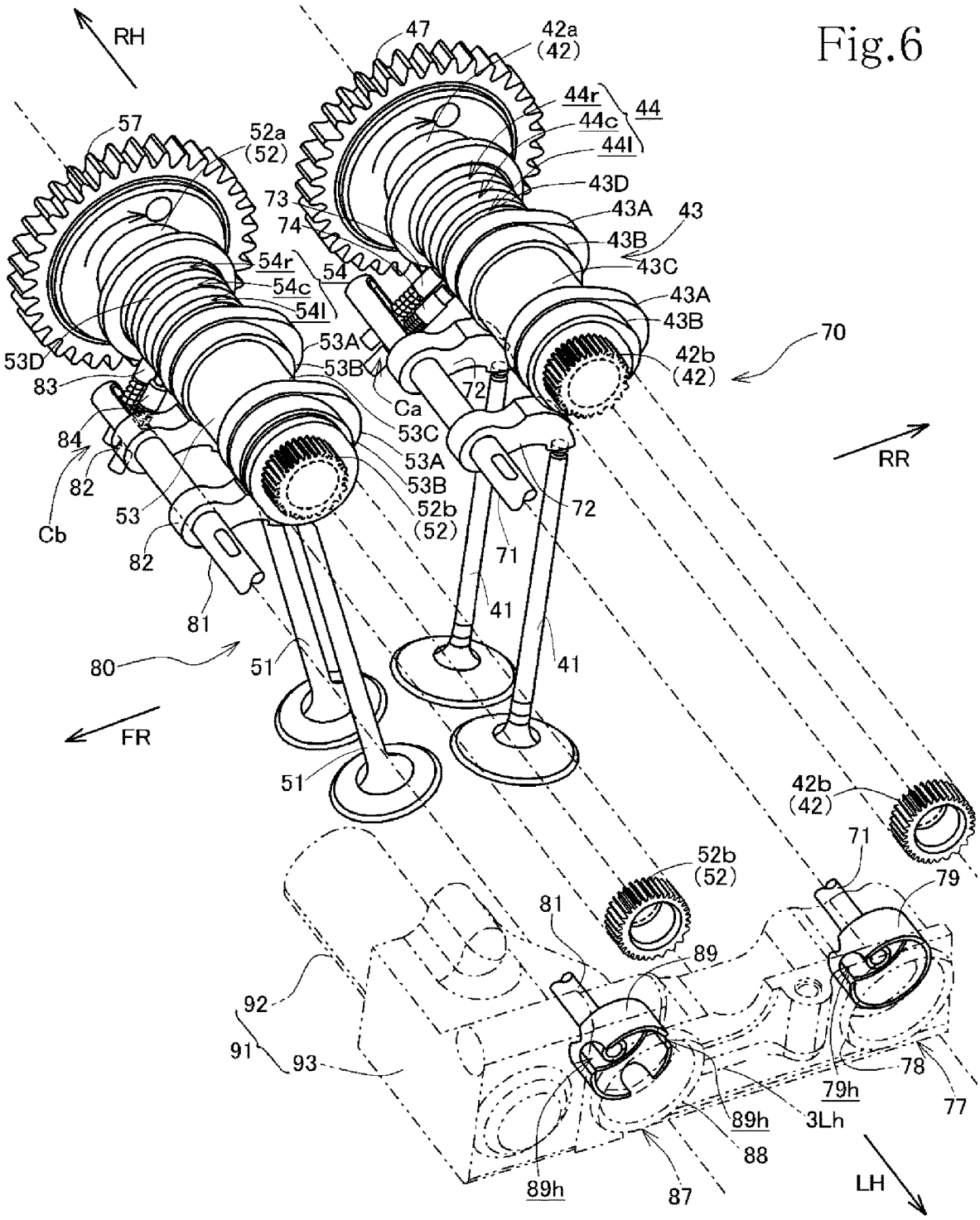
FIG. 6 is a perspective view of major parts of an intake cam switching mechanism and an exhaust cam switching mechanism that are partly omitted from illustration.

FIG. 6 is a perspective view of major parts of an intake cam switching mechanism and an exhaust cam switching mechanism that are partly omitted from illustration.

As depicted in FIGS. 5 and 6, each of the intake cam carriers 43 includes, on its outer circumferential surface, two left and right sets of a high-speed cam lobe 43A of a larger lobe lift and a low-speed cam lobe 43B of a smaller lobe lift which have different cam profiles, individually, and are disposed axially adjacent to each other, and a tubular journal 43C having a predetermined axial length that is interposed between the two left and right sets of the high-speed cam lobe 43A and the low-speed cam lobe 43B.

The high-speed cam lobe 43A and the low-speed cam lobe 43B that are disposed axially adjacent to each other have respective cam profile base circles whose outside diameters are identical to each other, and are disposed in respective identical angular positions (see FIGS. 4 and 5).

Each of the intake cam carriers 43 also includes a lead groove tube 43D disposed axially on the right side of the high-speed cam lobe 43A of the right set and having lead grooves 44 defined in an outer circumferential surface thereof and extending fully circumferentially therearound.

The lead groove tube 43D has an outside diameter slightly smaller than the identical outside diameter of the base circles of the high-speed cam lobe 43A and the low-speed cam lobe 43B.

The lead grooves 44 in the lead groove tube 43D include an annular lead groove 44*c* defined fully circumferentially on the lead groove tube 43D at a predetermined axial position thereon, and a right shift lead groove 44*r* and a left shift lead groove 441 that are branched leftward and rightward spirally from the annular lead groove 44*c* and spaced axially therefrom by respective predetermined distances (see FIG. 5).

The four intake cam carriers 43 thus constructed are arrayed on and splined to the splined shank 42*b* of the intake camshaft 42 at predetermined axially spaced intervals therebetween.

As depicted in FIG. 5, the intake camshaft 42 with the four intake cam carriers 43 arrayed thereon is rotatably supported by rear bearings 3*vv* on the bearing wall 3*vr* and the four bearing walls 3*v* of the upper cylinder head member 3U.

The journal 42*a* of the intake camshaft 42 is rotatably supported on the bearing wall 3*vr* and the tubular journals 43C of the respective intake cam carriers 43 are rotatably supported on the respective bearing walls 3*v*.

Similarly to the intake cam carriers 43, each of the exhaust cam carriers 53 that are splined to the splined shank 52*b* of the exhaust camshaft 52 includes, on its outer circumferential surface, two left and right sets of a high-speed cam lobe 53A of a larger lobe lift and a low-speed cam lobe 53B of a smaller lobe lift which have different cam profiles, individually, and are disposed axially adjacent to each other, and a tubular journal 53C having a predetermined axial length that is interposed between the two left and right sets of the high-speed cam lobe 53A and the low-speed cam lobe 53B. Each of the exhaust cam carriers 53 also includes a lead groove tube 53D disposed axially on the right side of the high-speed cam lobe 53A of the right set and having lead grooves 54 defined in an outer circumferential surface thereof and extending fully circumferentially therearound.

The lead grooves 54 in the lead groove tube 53D include an annular lead groove 54*c* defined fully circumferentially on the lead groove tube 53D at a predetermined axial position thereon, and a right shift lead groove 54*r* and a left shift lead groove 541 that are branched leftward and rightward spirally from the annular lead groove 54*c* and spaced axially therefrom by respective predetermined distances (see FIG. 5).

The four exhaust cam carriers 53 thus constructed are arrayed on and splined to the splined shank 52*b* of the exhaust camshaft 52 at predetermined axially spaced intervals therebetween. As depicted in FIG. 5, the exhaust camshaft 52 with the four exhaust cam carriers 53 arrayed thereon is rotatably supported by front bearings 3*vv* on the bearing walls 3*v* and 3*vr* of the upper cylinder head member 3U.

The journal 52*a* of the exhaust camshaft 52 is rotatably supported on the bearing wall 3*vr* and the tubular journals 53C of the respective exhaust cam carriers 53 are rotatably supported on the respective bearing walls 3*v*.

When the intake camshaft 42 (and the intake cam carriers 43) and the exhaust camshaft 52 (and the exhaust cam carriers 53) are supported on the bearing wall 3*vr* and the four bearing walls 3*v* of the upper cylinder head member 3U, the intake camshaft 42 (and the intake cam carriers 43) and the exhaust camshaft 52 (and the exhaust cam carriers 53) are sandwiched and rotatably supported by the camshaft holder 33 (see FIG. 4) that is placed over the bearing wall 3*vr* and the four bearing walls 3*v*.

Specifically, the four intake cam carriers 43 are co-rotatably and axially slidably supported on the intake camshaft 42, and the four exhaust cam carriers 53 are also co-rotatably and axially slidably supported on the exhaust camshaft 52.

The intake driven gear 47 mounted on the right end of the intake camshaft 42 and the exhaust driven gear 57 mounted on the right end of the exhaust camshaft 52 are of the same diameter and are placed side by side individually in rear and front positions in the cam chain compartment 3*c*. As shown in FIG. 4, a large-diameter idle gear 61 that is held in mesh with the intake driven gear 47 and the exhaust driven gear 57 is rotatably supported below the space therebetween.

As depicted in FIGS. 4 and 5, an idle chain sprocket 62 that is coaxial with the idle gear 61 is provided integrally with the idle gear 61 for rotation therewith. A cam chain 66 is trained around the idle chain sprocket 62 and a small-diameter chain sprocket, not depicted, fitted over the crankshaft 10 that is disposed below the idle chain sprocket 62.

When rotation of the crankshaft 10 is transmitted through the cam chain 66 to the idle chain sprocket 62, the idle gear 61 that is combined integrally with the idle chain sprocket 62 rotates, rotating the intake driven gear 47 and the exhaust driven gear 57 that are held in mesh with the idle gear 61. Therefore, the intake driven gear 47 rotates the intake camshaft 42 about its own axis, whereas the exhaust driven gear 57 rotates the exhaust camshaft 52 about its own axis.

As depicted in FIG. 6, an intake cam switching mechanism 70 includes an intake switching drive shaft 71 disposed obliquely forward and downward of and extending parallel to the intake camshaft 42, and an exhaust cam switching mechanism 80 includes an exhaust switching drive shaft 81 disposed obliquely forward and downward of and extending parallel to the exhaust camshaft 52.

The intake switching drive shaft 71 and the exhaust switching drive shaft 81 are supported on the upper cylinder head member 3U.

Figure 12:
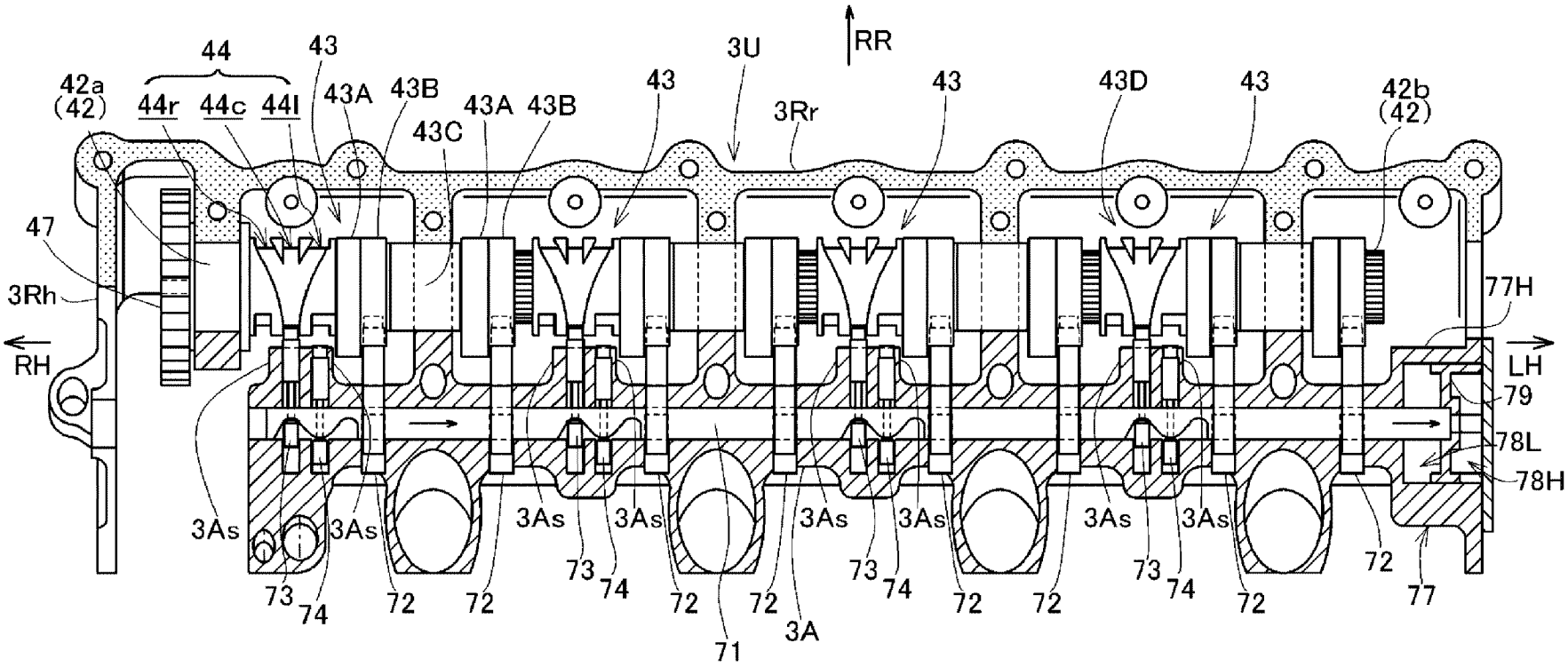
FIG. 12 is an elevational view depicting a manner in which major parts of the intake cam switching mechanism operate at the time the internal combustion engine operates in a low-speed range.

As depicted in FIGS. 5 and 12, the upper cylinder head member 3U houses therein a tubular rod 3A oriented in the leftward and rightward directions in the valve operating compartment 3*d* and extending straight through the bearing wall 3*vr* and the four bearing walls 3*v* at a position slightly rearward from the center of the valve operating compartment 3*d*.

Likewise, as shown in FIG. 5, the upper cylinder head member 3U also houses therein a tubular rod 3B oriented in the leftward and rightward directions in the valve operating compartment 3*d* and extending through the bearing wall 3*vr* and the four bearing walls 3*v* straight on an inner surface of the front side wall 3Fr of the valve operating compartment 3*d*.

The tubular rod 3A has an axial hole defined therein through which the intake switching drive shaft 71 is axially slidably fitted, and the tubular rod 3B has an axial hole defined therein through which the exhaust switching drive shaft 81 is axially slidably fitted.

The tubular rod 3A has two spaces or gaps defined therein at respective positions, corresponding individually to the left and right intake valves 41, on both sides of each of the bearing walls 3*v*, thereby exposing portions of the intake switching drive shaft 71. Intake rocker arms 72 are swingably supported on the exposed portions of the intake switching drive shaft 71 (see FIGS. 5 and 12).

In other words, the intake switching drive shaft 71 doubles as a rocker arm shaft.

As depicted in FIGS. 4 and 6, each of the intake rocker arms 72 has a distal end held in abutment against the upper end of one of the intake valves 41 and an upper curved end surface held in sliding contact with the high-speed cam lobe 43A or the low-speed cam lobe 43B of one of the sets dependent on axial movement of the corresponding intake cam carrier 43.

Therefore, when the intake cam carrier 43 rotates about its own axis, the high-speed cam lobe 43A or the low-speed cam lobe 43B swings the intake rocker arm 72 according to the cam profile thereof, depressing the intake valve 41 to open the corresponding intake valve hole into the combustion chamber 30.

Similarly, the tubular rod 3B has two spaces or gaps defined therein at respective positions, corresponding individually to the left and right exhaust valves 51, on both sides of each of the bearing walls 3*v*, thereby exposing portions of the exhaust switching drive shaft 81. Exhaust rocker arms 82 are swingably supported on the exposed portions of the exhaust switching drive shaft 81 (see FIGS. 5 and 6).

In other words, the exhaust switching drive shaft 81 doubles as a rocker arm shaft.

As depicted in FIGS. 4 and 6, each of the exhaust rocker arms 82 has a distal end held in abutment against the upper end of one of the exhaust valves 51 and has an upper curved end surface held in sliding contact with the high-speed cam lobe 53A or the low-speed cam lobe 53B of one of the sets, dependent on axial movement of the corresponding exhaust cam carrier 53.

Therefore, when the exhaust cam carrier 53 rotates about its own axis, the high-speed cam lobe 53A or the low-speed cam lobe 53B swings the exhaust rocker arm 82 according to the cam profile thereof, depressing the exhaust valve 51 to open the corresponding exhaust valve hole into the combustion chamber 30.

Referring to FIG. 12, the tubular rod 3A has thereon two left and right cylindrical bosses 3As that are adjacent to each other in the leftward and rightward directions. The cylindrical bosses 3As are disposed at respective positions corresponding to and projecting toward the lead groove tube 43D of each of the intake cam carriers 43.

The cylindrical bosses 3As have respective bores defined therein which extend through the tubular rod 3A.

A first switching pin 73 and a second switching pin 74 are slidably fitted individually in the bores in the left and right cylindrical bosses 3As.

Figure 7:
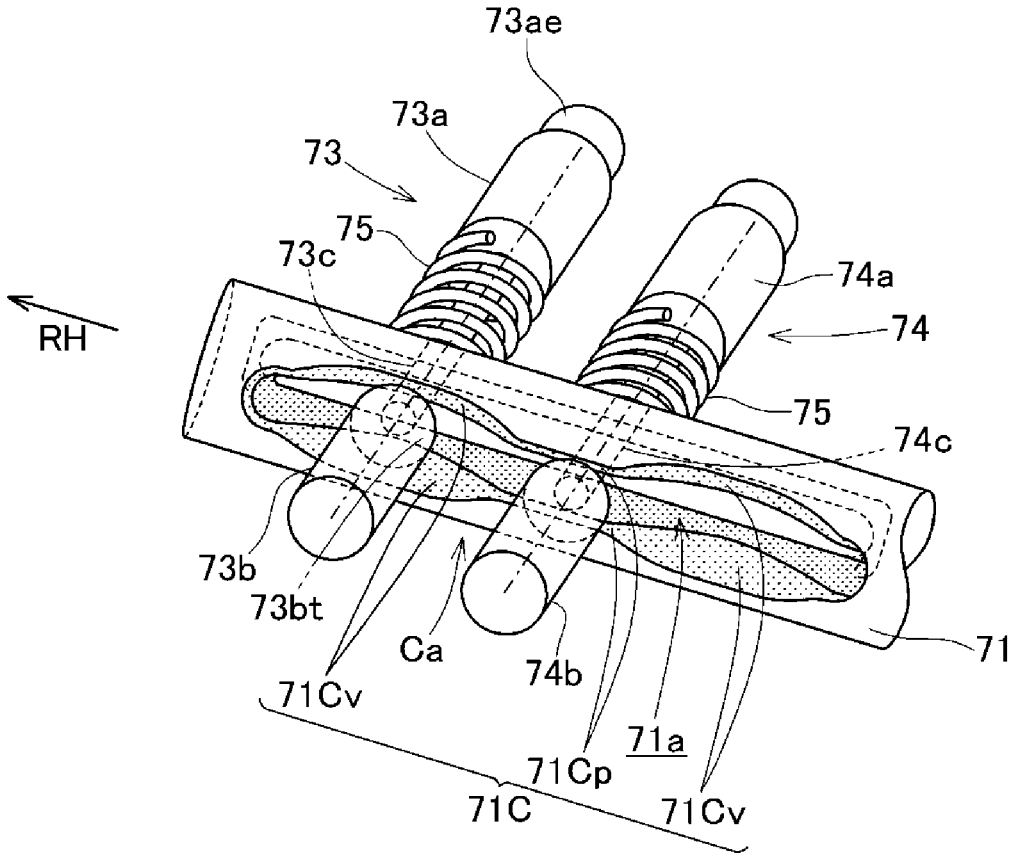
FIG. 7 is a perspective view of a first switching pin and a second switching pin that are combined with an intake switching drive shaft.

As depicted in FIG. 7, the first switching pin 73 includes a distal cylindrical column 73*a*, a proximal cylindrical column 73*b*, and an intermediate joint bar 73*c* interconnecting the distal cylindrical column 73*a* and the proximal cylindrical column 73*b* coaxially in line with each other.

The proximal cylindrical column 73*b* is smaller in outside diameter than the distal cylindrical column 73*a*.

The distal cylindrical column 73*a* includes a reduced-diameter engaging end 73*ae* projecting axially in a direction away from the proximal cylindrical column 73*b*.

The proximal cylindrical column 73*b* has a conical end face 73*bt* that faces and is joined to the intermediate joint bar 73*c*.

The second switching pin 74 is of a shape identical to the first switching pin 73, and includes a distal cylindrical column 74*a*, a proximal cylindrical column 74*b*, and an intermediate joint bar 74*c* interconnecting the distal cylindrical column 74*a* and the proximal cylindrical column 74*b* coaxially in line with each other.

As depicted in FIG. 7, the intake switching drive shaft 71 has an elongate hole 71*a* defined axially centrally therethrough.

The elongate hole 71*a* has a width slightly larger than the diameter of the intermediate joint bar 73*c* of the first switching pin 73, but smaller than the diameter of the proximal cylindrical column 73*b*.

The intake switching drive shaft 71 also has a cam surface 71C on an open end face of the elongate hole 71*a*. The cam surface 71C includes two left recessed faces 71Cv and two right recessed faces 710*v* that are disposed successively in the leftward and rightward directions with flat faces 71Cp interposed therebetween.

The first switching pin 73 is installed on the intake switching drive shaft 71 such that the intermediate joint bar 73*c* thereof extends diametrically through the elongate hole 71*a* in the intake switching drive shaft 71. The first switching pin 73 is normally biased by a helical spring 75 to press the conical end face 73*bt* of the proximal cylindrical column 73*b* against the cam surface 71C on the open end face of the elongate hole 71*a* in the intake switching drive shaft 71. When the intake switching drive shaft 71 moves axially, the cam surface 71C moves in sliding contact with the conical end face 73*bt* of the proximal cylindrical column 73*b* of the first switching pin 73, which is kept in a fixed position with respect to the axial directions of the intake switching drive shaft 71 and is slidable in directions perpendicularly to the axial directions of the intake switching drive shaft 71. Therefore, the intake switching drive shaft 71 and the first switching pin 73 (and also the second switching pin 74) jointly make up a linear-motion cam mechanism Ca for moving the first switching pin 73 back and forth in the directions perpendicularly to the axial directions of the intake switching drive shaft 71 while being guided by the cam profile of the cam surface 71C upon axial movement of the intake switching drive shaft 71.

As depicted in FIG. 7, the first switching pin 73 and the second switching pin 74 extend diametrically through the common elongate hole 71*a* in the intake switching drive shaft 71 and are arrayed parallel to each other.

In FIG. 7, the right recessed faces 71Cv of the cam surface 71C of the intake switching drive shaft 71 have their centers positioned on the first switching pin 73, whose conical end face 73*bt* is held in abutment against the right recessed faces 71Cv, placing the first switching pin 73 in an advanced position, while the conical end face 74*bt* of the proximal cylindrical column 74*b* of the second switching pin 74 is held in abutment against the flat faces 71Cp of the cam surface 71C, placing the second switching pin 74 in a retracted position.

When the intake switching drive shaft 71 moves axially to the right, the conical end face 73*bt* of the first switching pin 73 slides up from the centers of the right recessed faces 710*v* along slanting surfaces thereof while being retracted onto the flat faces 71Cp. On the other hand, the conical end face 74*bt* of the second switching pin 74 slides down from the flat surfaces 71Cp along slanting surfaces of the left recessed faces 71Cv while being advanced onto the centers of the left recessed faces 71Cv.

In this manner, the first switching pin 73 and the second switching pin 74 are alternatively advanced and retracted upon axial movement of the intake switching drive shaft 71.

Although not depicted, the tubular rod 3B, in which the exhaust switching drive shaft 81 is axially slidably fitted, also has two left and right cylindrical bosses 3Bs that are adjacent to each other in the leftward and rightward directions, disposed at respective positions corresponding to and projecting toward the lead groove tube 53D of each of the exhaust cam carriers 53. The cylindrical bosses 3Bs have respective bores defined therein which extend through the tubular rod 3B, and a first switching pin 83 and a second switching pin 84 are slidably fitted individually in the bores in the left and right cylindrical bosses 3Bs. The first switching pin 83 and the second switching pin 84 extend diametrically through a common elongate hole 81*a* in the exhaust switching drive shaft 81 and are arrayed parallel to each other (see FIGS. 5 and 6).

The exhaust switching drive shaft 81 and the first and second switching pins 83 and 84 jointly make up a linear-motion cam mechanism Cb for moving the first and second switching pins 83 and 84 back and forth in the directions perpendicularly to the axial directions of the exhaust switching drive shaft 81 while being guided by the cam profile of a cam surface 81C (see FIG. 8), which is formed on an open end face of the elongate hole 81*a* and is of the same cam profile as the cam surface 71C, upon axial movement of the exhaust switching drive shaft 81.

As depicted in FIG. 5, the exhaust switching drive shaft 81 and the first and second switching pins 83 and 84 in the cylindrical bosses 3Bs are disposed so as to be at least partly superposed on axial extensions of the right four stud bolts 7 on the front side (exhaust side), of all the (ten) stud bolts 7 by which the cylinder block 2 and the cylinder head 3 are stacked on and fastened to the crankcase 1.

Referring to FIGS. 5 and 6, an intake hydraulic pressure actuator 77 for axially moving the intake switching drive shaft 71 is mounted on the left side wall 3Lh of the upper cylinder head member 3U and projects into the valve operating compartment 3*d*, and an exhaust hydraulic pressure actuator 87 for axially moving the exhaust switching drive shaft 81 is mounted on the left side wall 3Lh of the upper cylinder head member 3U and projects into the valve operating compartment 3*d*. The exhaust hydraulic pressure actuator 87 is disposed forwardly of the intake hydraulic pressure actuator 77 in side-by-side relationship.

The intake hydraulic pressure actuator 77 and the exhaust hydraulic pressure actuator 87 are formed integrally with the upper cylinder head member 3U.

As depicted in FIG. 5, the intake hydraulic pressure actuator 77 and the exhaust hydraulic pressure actuator 87 are disposed so as to be at least partly superposed on axial extensions of the leftmost two stud bolts 7 of all the (ten) stud bolts 7 by which the cylinder block 2 and the cylinder head 3 are stacked on and fastened to the crankcase 1.

Figure 8:
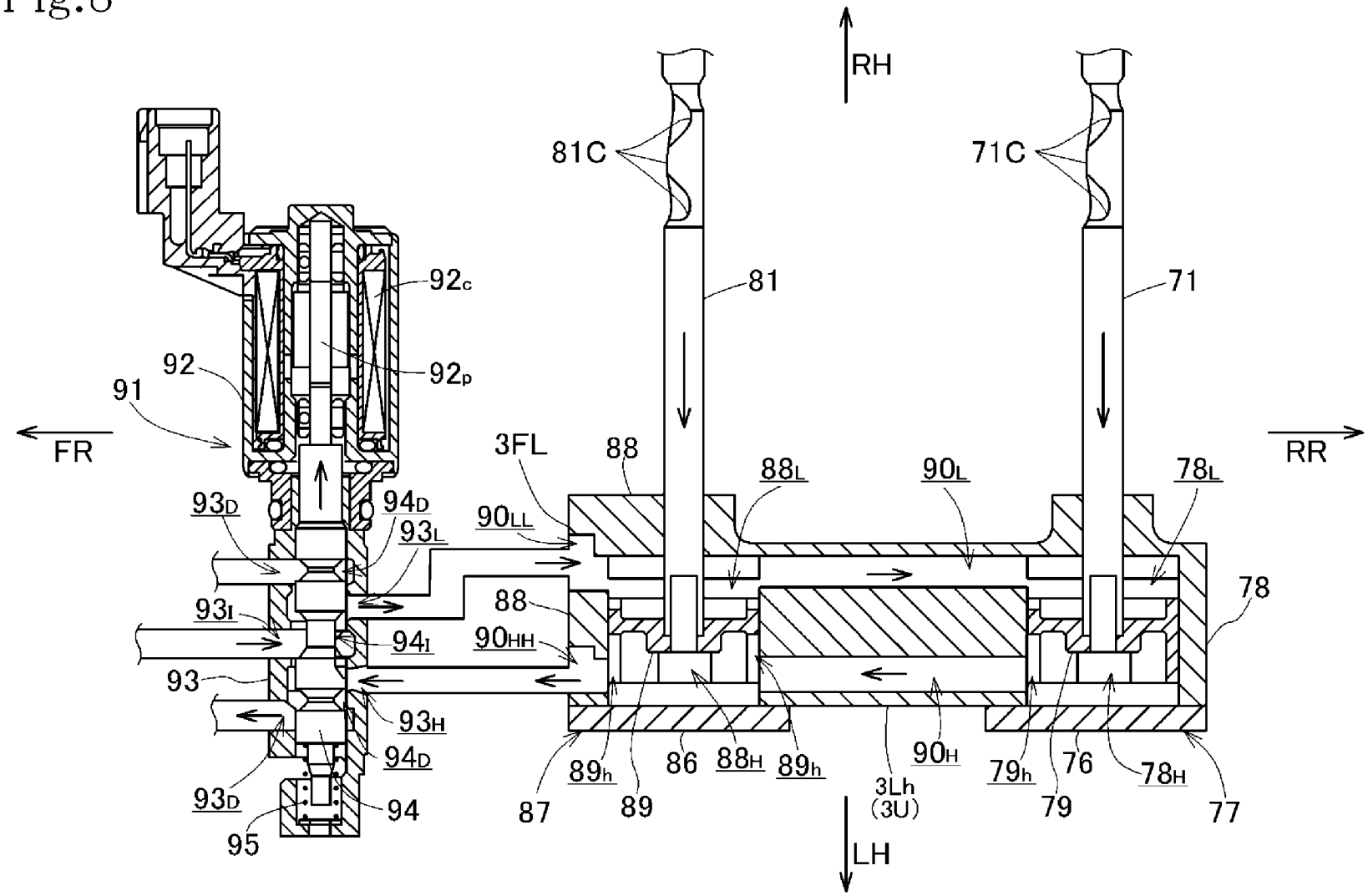
FIG. 8 is a sectional view depicting a manner in which oil under pressure is supplied to and discharged from an intake hydraulic pressure actuator and an exhaust hydraulic pressure actuator at the time a linear solenoid valve is not actuated.
Figure 9:
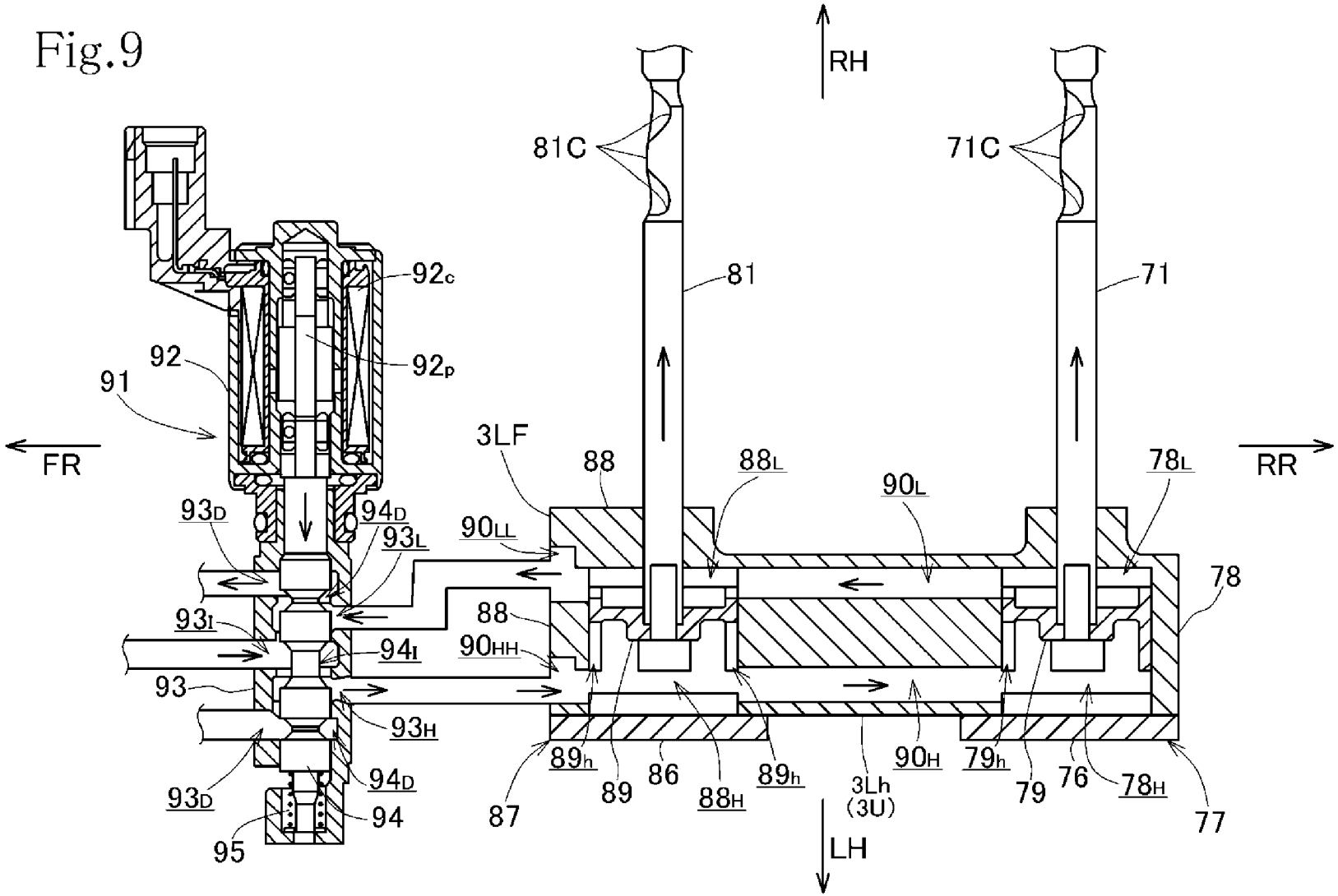
FIG. 9 is a sectional view depicting a manner in which oil under pressure is supplied to and discharged from the intake hydraulic pressure actuator and the exhaust hydraulic pressure actuator at the time the linear solenoid valve is actuated.

As depicted in FIGS. 8 and 9, the intake hydraulic pressure actuator 77 includes an intake actuator housing 78 having an inner housing chamber defined therein as a round hole and an intake actuator drive body 79 having a bottomed hollow cylindrical shape fitted in the inner housing chamber for reciprocating sliding movement in the axial directions (leftward and rightward directions) of the intake switching drive shaft 71. The intake switching drive shaft 71 has a left end securely fitted in the intake actuator drive body 79 for movement therewith.

The inner housing chamber in the intake actuator housing 78 has a left opening closed by a lid 76 and is divided into a left high-speed hydraulic pressure chamber $\mathbf{78}_H$ and a right low-speed hydraulic pressure chamber $\mathbf{78}_L$ by the intake actuator drive body 79.

Likewise, the exhaust hydraulic pressure actuator 87 includes an exhaust actuator housing 88 having an inner housing chamber defined therein as a round hole and an exhaust actuator drive body 89 having a bottomed hollow cylindrical shape fitted in the inner housing chamber for reciprocating sliding movement in the axial directions (leftward and rightward directions) of the exhaust switching drive shaft 81. The exhaust switching drive shaft 81 has a left end securely fitted in the exhaust actuator drive body 89 for movement therewith.

The inner housing chamber in the exhaust actuator housing 88 has a left opening closed by a lid 86 and is divided into a left high-speed hydraulic pressure chamber $\mathbf{88}_H$ and a right low-speed hydraulic pressure chamber 881, by the exhaust actuator drive body 89.

Still referring to FIGS. 8 and 9, the left side wall 3Lh of the upper cylinder head member 3U has a high-speed oil supply and discharge channel $\mathbf{90}_H$ defined therein that provides fluid communication between the high-speed hydraulic pressure chamber $\mathbf{78}_H$ of the intake hydraulic pressure actuator 77 and the high-speed hydraulic pressure chamber $\mathbf{88}_H$ of the exhaust hydraulic pressure actuator 87. The left side wall 3Lh of the upper cylinder head member 3U also has a low-speed oil supply and discharge channel $\mathbf{90}_L$ defined therein that provides fluid communication between the low-speed hydraulic pressure chamber $\mathbf{78}_L$ of the intake hydraulic pressure actuator 77 and the low-speed hydraulic pressure chamber $\mathbf{88}_L$ of the exhaust hydraulic pressure actuator 87.

Figure 10:
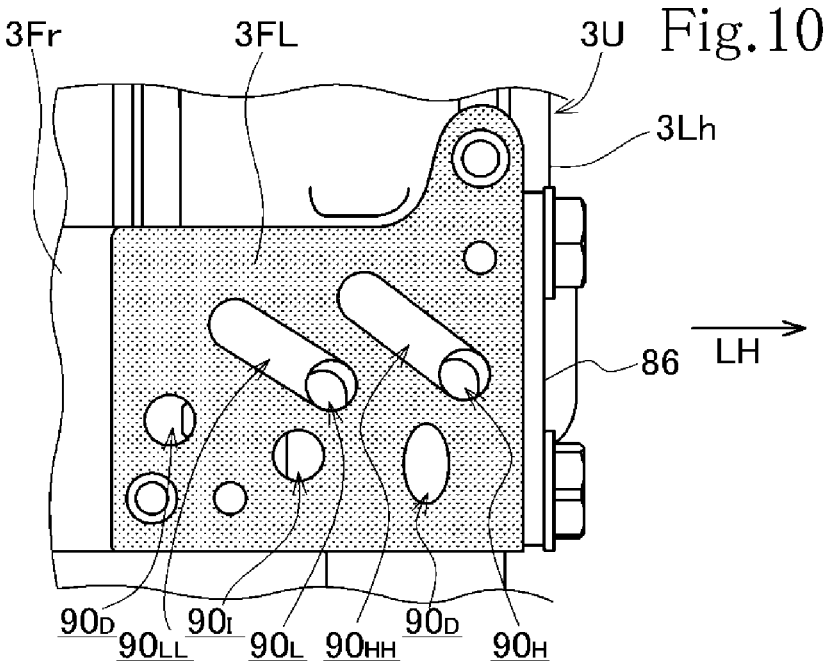
FIG. 10 is a front elevational view of a left end mating surface of a front face of a front wall of the upper cylinder head member.

The high-speed oil supply and discharge channel $\mathbf{90}_H$ extends forwardly through the high-speed hydraulic pressure chamber $\mathbf{88}_H$ of the exhaust hydraulic pressure actuator 87 and, as shown in FIG. 10, is open at a left end mating surface 3FL on the left end of a front surface of the front side wall 3Fr of the upper cylinder head member 3U. The low-speed oil supply and discharge channel $\mathbf{90}_L$ extends forwardly through the low-speed hydraulic pressure chamber $\mathbf{88}_L$ of the exhaust hydraulic pressure actuator 87 and, as shown in FIG. 10, is open at the left end mating surface 3FL of the front side wall 3Fr.

The intake actuator drive body 79, shaped as a bottomed hollow cylinder, of the intake hydraulic pressure actuator 77 has an axially elongate hole 79*h* defined in a hollow cylindrical portion thereof that faces the high-speed oil supply and discharge channel $\mathbf{90}_H$. Consequently, even when the intake actuator drive body 79 is axially moved in the inner housing chamber, the fluid communication port of the high-speed oil supply and discharge channel $\mathbf{90}_H$ which is defined in the intake actuator housing 78 and open into the inner housing chamber, faces the axially elongate hole 79*h* in the hollow cylindrical portion of the intake actuator drive body 79 at all times, always keeping the high-speed oil supply and discharge channel $\mathbf{90}_H$ and the high-speed hydraulic pressure chamber $\mathbf{78}_H$ in fluid communication with each other.

The exhaust actuator drive body 89, shaped as a bottomed hollow cylinder, of the exhaust hydraulic pressure actuator 87 has two axially elongate holes 89*h* defined in hollow cylindrical portions thereof that face the high-speed oil supply and discharge channel $\mathbf{90}_H$. Consequently, even when the exhaust actuator drive body 89 is axially moved in the inner housing chamber, the fluid communication port of the high-speed oil supply and discharge channel $\mathbf{90}_H$ which is defined in the exhaust actuator housing 88 and open into the inner housing chamber, faces the axially elongate holes 89*h* in the hollow cylindrical portions of the exhaust actuator drive body 89 at all times, always keeping the high-speed oil supply and discharge channel $\mathbf{90}_H$ and the high-speed hydraulic pressure chamber $\mathbf{88}_H$ in fluid communication with each other.

The low-speed oil supply and discharge channel $\mathbf{90}_L$ is held in fluid communication with the low-speed hydraulic pressure chamber $\mathbf{78}_1$, of the intake hydraulic pressure actuator 77 and the low-speed hydraulic pressure chamber $\mathbf{88}_L$ of the exhaust hydraulic pressure actuator 87 at all times even when the intake actuator drive body 79 of the intake hydraulic pressure actuator 77 and the exhaust actuator drive body 89 of the exhaust hydraulic pressure actuator 87 are axially moved to the left or right.

FIG. 10 depicts the left end mating surface 3FL on the left end of the front surface of the front side wall 3Fr of the upper cylinder head member 3U. As shown in FIG. 10, the high-speed oil supply and discharge channel $\mathbf{90}_H$ and the low-speed oil supply and discharge channel $\mathbf{90}_L$ are open at the left end mating surface 3FL, and oblong grooves $\mathbf{90}_{HH}$ and $\mathbf{90}_{LL}$ are defined in the left end mating surface 3FL and extend obliquely upward from the openings of the high-speed oil supply and discharge channel $\mathbf{90}_H$ and the low-speed oil supply and discharge channel $\mathbf{90}_L$.

A linear solenoid valve 91 (see FIG. 9) is mounted on the left end mating surface 3FL on the left end of the front surface of the front side wall 3Fr of the upper cylinder head member 3U.

As depicted in FIGS. 8 and 9, the linear solenoid valve 91 includes an electromagnetic solenoid 92 including a plunger 92*p* movable in an electromagnetic coil 92*c*, and a sleeve 93 connected to and extending axially from the electromagnetic solenoid 92.

A spool valve 94 is slidably inserted in the sleeve 93 and normally biased by a spring 95 to abut coaxially against the plunger 92*p*.

The linear solenoid valve 91 is mounted on the left end mating surface 3FL on the left end of a front surface of the front side wall 3Fr of the upper cylinder head member 3U such that the spool valve 94 which is coaxial with the plunger 92*p* of the electromagnetic solenoid 92 is oriented horizontally in the leftward and rightward directions (see FIGS. 2, 3, and 5).

As depicted in FIGS. 8 and 9, the spool valve 94 of the linear solenoid valve 91 is oriented in the leftward and rightward directions parallel to the intake switching drive shaft 71 and the exhaust switching drive shaft 81, and is movable selectively in the leftward and rightward directions.

When the electromagnetic coil 92*c* is energized, the plunger 92*p* is axially shifted in the leftward direction under electromagnetic forces, pushing the spool valve 94 in the sleeve 93 to the left (LH) against the bias of the spring 95 (see FIG. 9). When the electromagnetic coil 92*c* is de-energized, the plunger 92*p* is released and pushed back in the rightward direction by the spool valve 94 which is retracted to the right (RH) under the bias of the spring 95 (see FIG. 8).

The sleeve 93 has a central hydraulic pressure supply port $\mathbf{93}_I$ defined therein, a high-speed supply and discharge port $\mathbf{93}_H$ and a low-speed supply and discharge port $\mathbf{93}_L$ defined therein that are positioned individually on both sides of the central hydraulic pressure supply port $\mathbf{93}_I$, and a pair of drain ports $\mathbf{93}_D$ defined therein that are positioned individually on both sides of the high-speed supply and discharge port $\mathbf{93}_H$ and the low-speed supply and discharge port $\mathbf{93}_L$.

The spool valve 94 that is axially slidable in the sleeve 93 has a central hydraulic pressure supply groove 941 defined therein and a pair of drain grooves $\mathbf{94}_D$ defined therein that are positioned axially side by side individually on both sides of the central hydraulic pressure supply groove $\mathbf{94}_I$ with respective lands interposed therebetween.

In FIGS. 8 and 9, the sleeve 93 of the linear solenoid valve 91 is schematically illustrated.

Figure 11:
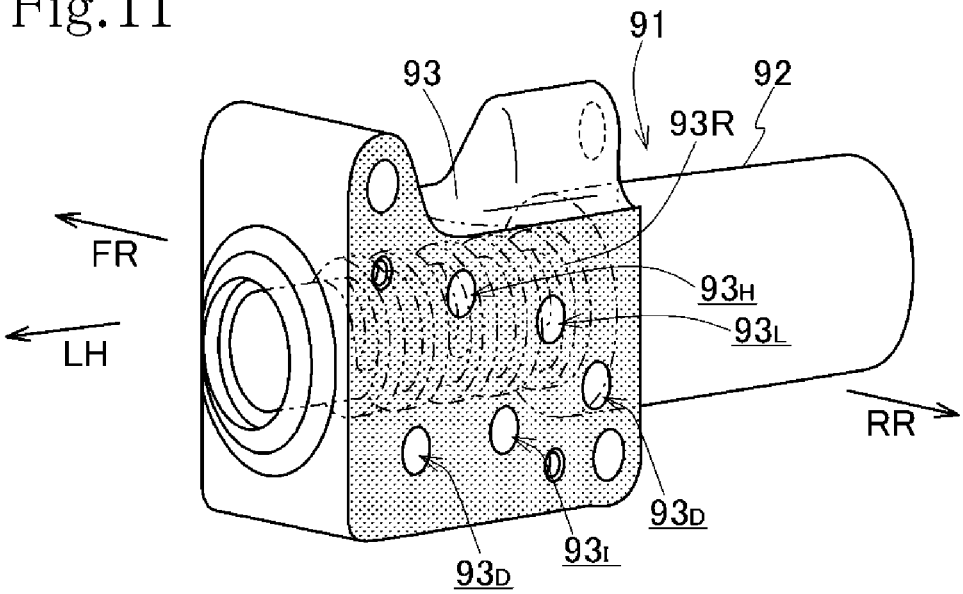
FIG. 11 is a perspective view of the linear solenoid valve.

FIG. 11 depicts the linear solenoid valve 91 in realistic representation. The sleeve 93 has a mating surface 93R as a rear side surface thereof, and the central hydraulic pressure supply port $\mathbf{93}_1$, the high-speed supply and discharge port $93_H$ the low-speed supply and discharge port $93_L$, and the drain ports $93_D$ are open at the mating surface 93R.

The mating surface 93R as a rear side surface of the sleeve 93 of the linear solenoid valve 91 mates with the left end mating surface 3FL (see FIG. 10) on the left end of the front surface of the front side wall 3Fr of the upper cylinder head member 3U, so that the linear solenoid valve 91 is mounted on the upper cylinder head member 3U.

The left end mating surface 3FL of the front side wall 3Fr of the upper cylinder head member 3U depicted in FIG. 10 has respective openings defined therein of a hydraulic pressure supply channel $90_1$, the oblong groove $90_{14H}$ connected to the high-speed oil supply and discharge channel $90_H$, the oblong groove $90_{LL}$ connected to the low-speed oil supply and discharge channel $90_L$, and a pair of drain oil channels $90_D$ in facing relation to respective openings of the central hydraulic pressure supply port $93_I$, the high-speed supply and discharge port $93_H$, the low-speed supply and discharge port $93_L$, and the drain ports $93_D$ in the sleeve 93.

In FIG. 8, the electromagnetic solenoid 92 of the linear solenoid valve 91 is de-energized, and the spool valve 94 is retracted to the right (RH) under the bias of the spring 95. Therefore, oil under pressure that has flowed into the central hydraulic pressure supply port $93_I$ of the sleeve 93 flows through the central hydraulic pressure supply groove 941 into the low-speed supply and discharge port $93_L$, from which the oil flows through the oblong groove $90_{LL}$ into the low-speed oil supply and discharge channel $90_L$ in the left side wall 3Lh of the upper cylinder head member 3U and is supplied to the low-speed hydraulic pressure chamber $88_L$ of the exhaust hydraulic pressure actuator 87 and then via the low-speed hydraulic pressure chamber $88_L$ to the low-speed hydraulic pressure chamber $78_L$ of the intake hydraulic pressure actuator 77, pushing the intake actuator drive body 79 of the intake hydraulic pressure actuator 77 and the exhaust actuator drive body 89 of the exhaust hydraulic pressure actuator 87 to the left (LH).

Since the actuator drive bodies 79 and 89 of the intake and exhaust hydraulic pressure actuators 77 and 87 are moved to the left (LH), oil under pressure flows out of the high-speed hydraulic pressure chambers $78_H$ and $88_H$ of the intake and exhaust hydraulic pressure actuators 77 and 87 into the high-speed oil supply and discharge channel $90_H$, from which the oil flows through the oblong groove $90_{HH}$ into the high-speed supply and discharge port $93_H$ in the sleeve 93 of the linear solenoid valve 91, and is then discharged via the drain groove $94_D$ from the drain port $93_D$ into the drain oil channel $90_D$.

When the electromagnetic solenoid 92 of the linear solenoid valve 91 is de-energized as described above, as depicted in FIG. 8, oil under pressure is supplied to the low-speed hydraulic pressure chambers $78_L$ and $88_L$ of the intake and exhaust hydraulic pressure actuators 77 and 87, and oil under pressure flows out of the high-speed hydraulic pressure chambers $78_H$ and $88_H$ thereof, moving the actuator drive bodies 79 and 89 of the intake and exhaust hydraulic pressure actuators 77 and 87 simultaneously to the left (LH), thereby moving the intake switching drive shaft 71 and the exhaust switching drive shaft 81 whose left ends are securely fitted respectively in the actuator drive bodies 79 and 89 also simultaneously to the left (LH).

When the electromagnetic solenoid 92 of the linear solenoid valve 91 is energized, as depicted in FIG. 9, the spool valve 94 projects to the left (LH) against the bias of the spring 95, oil under pressure that has flowed into the central hydraulic pressure supply port $93_I$ of the sleeve 93 flows through the central hydraulic pressure supply groove $94_I$ into the high-speed supply and discharge port $93_H$, from which the oil flows through the oblong groove $90_{HH}$ into the high-speed oil supply and discharge channel $90_H$ in the left side wall 3Lh of the upper cylinder head member 3U and is supplied to the high-speed hydraulic pressure chamber $88_H$ of the exhaust hydraulic pressure actuator 87 and then via the high-speed hydraulic pressure chamber $88_H$ to the high-speed hydraulic pressure chamber $78_H$ of the intake hydraulic pressure actuator 77, pushing the intake actuator drive body 79 of the intake hydraulic pressure actuator 77 and the exhaust actuator drive body 89 of the exhaust hydraulic pressure actuator 87 to the right (RH).

Oil under pressure flows out of the low-speed hydraulic pressure chambers $78_L$ and $88_L$ of the intake and exhaust hydraulic pressure actuators 77 and 87 into the low-speed oil supply and discharge channel $90_L$, from which the oil flows through the oblong groove $90_{LL}$ into the low-speed supply and discharge port $93_L$ in the sleeve 93 of the linear solenoid valve 91, and is then discharged via the drain groove $94_D$ from the drain port $93_D$ into the drain oil channel $90_D$.

When the electromagnetic solenoid 92 of the linear solenoid valve 91 is energized as described above, as depicted in FIG. 9, oil under pressure is supplied to the high-speed hydraulic pressure chambers $78_H$ and $88_H$ of the intake and exhaust hydraulic pressure actuators 77 and 87, and oil under pressure flows out of the low-speed hydraulic pressure chambers $78_L$ and $88_L$ thereof, moving the actuator drive bodies 79 and 89 of the intake and exhaust hydraulic pressure actuators 77 and 87 simultaneously to the right (RH), thereby moving the intake switching drive shaft 71 and the exhaust switching drive shaft 81 whose left ends are securely fitted respectively in the actuator drive bodies 79 and 89 also simultaneously to the right (RH).

When the electromagnetic solenoid 92 of the linear solenoid valve 91 is de-energized, moving the intake switching drive shaft 71 and the exhaust switching drive shaft 81 to the left (LH), as described above, the first switching pin 73 of each linear-motion cam mechanism Ca is in the advanced position where it abuts against the recessed face 71Cv of the cam surface 71C of the intake switching drive shaft 71 and the second switching pin 74 of each linear-motion cam mechanism Ca is in the retracted position where it abuts against the flat face 71Cp of the cam surface 71C in the intake cam switching mechanism 70 depicted in FIG. 12.

The advanced first switching pin 73 engages in the annular lead groove 44*c* of the lead groove tube 43D of the intake cam carrier 43 that has moved to the right, whereupon the intake cam carrier 43 is kept in a predetermined right position rather than moving axially.

While the intake cam carrier 43 is in the predetermined right position (low-speed position), as depicted in FIG. 12, the low-speed cam lobe 43B acts on the intake rocker arm 72, causing the intake valve 41 to operate according to low-speed valve operating characteristics set by the cam profile of the low-speed cam lobe 43B.

In other words, the internal combustion engine E operates in a low-speed mode.

Figure 13:
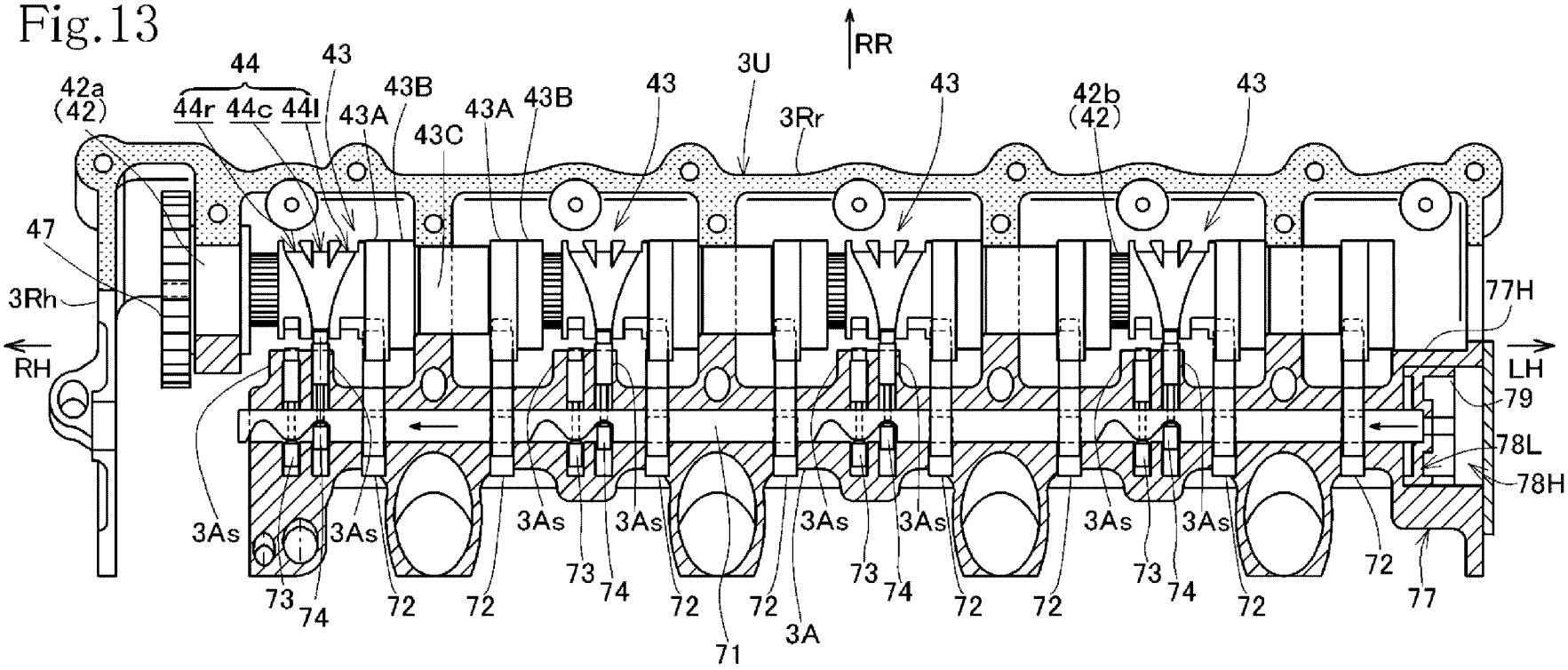
FIG. 13 is an elevational view depicting a manner in which the major parts of the intake cam switching mechanism operate at the time the internal combustion engine operates in a high-speed range.

When the electromagnetic solenoid 92 of the linear solenoid valve 91 is then energized, moving the intake switching drive shaft 71 to the right (RH), as depicted in FIG. 13, the conical end face 73*bt* of the first switching pin 73 slides from the centers of the right recessed faces 710*v* up the slanting surfaces thereof as it is retracted onto the flat faces 71Cp, and the conical end face 74*bt* of the second switching pin 74 slides from the flat surfaces 71Cp down the slanting surfaces of the left recessed faces 71Cv as it is advanced onto the centers of the left recessed faces 71Cv.

The retracted first switching pin 73 disengages from the annular lead groove 44*c* in the intake cam carrier 43, and the advanced second switching pin 74 engages into the left shift lead groove 441. Therefore, the intake cam carrier 43 is moved axially to the left while rotating and being guided by the left shift lead groove 441. As depicted in FIG. 13, the second switching pin 74 shifts from the left shift lead groove 441 into the annular lead groove 44*c*, keeping the intake cam carrier 43 in a predetermined left position.

While the intake cam carrier 43 is in the predetermined left position (high-speed position), as depicted in FIG. 13, the high-speed cam lobe 43A acts on the intake rocker arm 72, causing the intake valve 41 to operate according to high-speed valve operating characteristics set by the cam profile of the high-speed cam lobe 43A.

In other words, the internal combustion engine E operates in a high-speed mode.

When the intake switching drive shaft 71 is moved to the left while the internal combustion engine E is operating in the high-speed mode, the second switching pin 74 is retracted out of the annular lead groove 44*c*, and the first switching pin 73 is advanced into the right shift lead groove 44*r*. The intake cam carrier 43 is guided by the right shift lead groove 44*r* to move axially to the right while rotating. As depicted in FIG. 12, the intake cam carrier 43 is now kept in the predetermined right position (low-speed position), and the internal combustion engine E operates in the low-speed mode with the low-speed cam lobe 43B acting on the intake rocker arm 72.

The exhaust cam switching mechanism 80 also operates depending on movement of the exhaust switching drive shaft 81 in the same manner as the intake cam switching mechanism 70 operates depending on movement of the intake switching drive shaft 71 as the electromagnetic solenoid 92 of the linear solenoid valve 91 is energized and de-energized as described above.

The variable valve operating apparatus 40 according to the embodiment of the present invention described in detail above offers the following advantages.

As depicted in FIG. 6, the intake switching drive shaft 71 parallel to the intake camshaft 42, as it is actuated, causes the cam mechanism Ca to advance and retract the first and second switching pins 73 and 74. Therefore, the intake cam switching mechanism 70 is of a simple structure made up of a reduced number of parts, and the drive mechanism for axially moving the intake switching drive shaft 71 of the intake cam switching mechanism 70 is of a simple compact structure in which the intake actuator drive body 79 of the intake hydraulic pressure actuator 77 is coupled to the end of the intake switching drive shaft 71. Consequently, the internal combustion engine E is prevented from being large in size and is low in cost.

Similarly, the exhaust cam switching mechanism 80 is of a simple structure made up of a reduced number of parts, and the drive mechanism for axially moving the exhaust switching drive shaft 81 is of a simple compact structure in which the exhaust actuator drive body 89 of the exhaust hydraulic pressure actuator 87 is coupled to the end of the exhaust switching drive shaft 81. Consequently, the internal combustion engine E is prevented from being large in size and is low in cost.

As the intake hydraulic pressure actuator 77 and the exhaust hydraulic pressure actuator 87 are formed integral with the upper cylinder head member 3U, the number of parts used is reduced, and the intake hydraulic pressure actuator 77 and the exhaust hydraulic pressure actuator 87 can be incorporated in a compact layout in the internal combustion engine.

Since the intake hydraulic pressure actuator 77 (the exhaust hydraulic pressure actuator 87) for reciprocally moving the intake actuator drive body 79 (the exhaust actuator drive body 89) under hydraulic pressure is used, the intake actuator drive body 79 (the exhaust actuator drive body 89) which is of a small size can be mounted on the end of the intake switching drive shaft 71 (the exhaust switching drive shaft 81) of the intake cam switching mechanism 70 (the exhaust cam switching mechanism 80), so that the internal combustion engine E is prevented from being large in size and the intake switching drive shaft 71 (the exhaust switching drive shaft 81) can be moved with good responsiveness under hydraulic pressure.

Inasmuch as the intake hydraulic pressure actuator 77 and the exhaust hydraulic pressure actuator 87 are provided respectively on the intake switching drive shaft 71 and the exhaust switching drive shaft 81, the individual intake and exhaust hydraulic pressure actuators 77 and 87 can be reduced in size and the intake switching drive shaft 71 and the exhaust switching drive shaft 81 can individually be moved quickly.

The exhaust hydraulic pressure actuator 87 is placed in the low-speed hydraulic liquid supply and discharge channel $\mathbf{90}_L$ (the high-speed hydraulic liquid supply and discharge channel $\mathbf{90}_H$) that supplies hydraulic liquid under pressure to and discharges hydraulic liquid under pressure from the intake hydraulic pressure actuator 77, so that hydraulic liquid under pressure flows through the exhaust hydraulic pressure actuator 87 before acting on the intake hydraulic pressure actuator 77. Consequently, the low-speed hydraulic liquid supply and discharge channel $\mathbf{90}_L$ (the high-speed hydraulic liquid supply and discharge channel $\mathbf{90}_H$) is shared by the intake hydraulic pressure actuator 77 and the exhaust hydraulic pressure actuator 87. The low-speed hydraulic liquid supply and discharge channel $\mathbf{90}_L$ (the high-speed hydraulic liquid supply and discharge channel $\mathbf{90}_H$) is thus made smaller and disposed in a more compact layout than if the low-speed hydraulic liquid supply and discharge channel $\mathbf{90}_L$ (the high-speed hydraulic liquid supply and discharge channel $\mathbf{90}_H$) is independently provided for each hydraulic pressure actuator, with the result that the internal combustion engine E is prevented from being large in size.

The low-speed hydraulic liquid supply and discharge channel $\mathbf{90}_L$ and the high-speed hydraulic liquid supply and discharge channel $\mathbf{90}_H$ are held in fluid communication respectively with the two hydraulic pressure chambers $\mathbf{78}_L$ and $\mathbf{78}_H$ ($\mathbf{88}_L$, $\mathbf{88}_H$) that are formed by dividing the inner housing chamber in the intake actuator housing 78 (the exhaust actuator housing 88) with the intake actuator drive body 79 (the exhaust actuator drive body 89). Therefore, the low-speed hydraulic liquid supply and discharge channel $\mathbf{90}_1$, and the high-speed hydraulic liquid supply and discharge channel $\mathbf{90}_H$ can be disposed in a compact layout parallel to the directions in which the intake actuator drive body 79 (the exhaust actuator drive body 89) moves, making it possible to prevent the internal combustion engine from being large in size.

As depicted in FIG. 6, the intake actuator drive body 79 (the exhaust actuator drive body 89) that is reciprocally movable in the inner housing chamber defined as a round hole is of a bottomed hollow cylindrical shape. As depicted in FIGS. 8 and 9, the elongate hole 79*h* (the elongate hole 89*h*) is defined in the hollow cylindrical portion in fluid communication with the high-speed oil supply and discharge channel $90_H$, and is elongate in the directions in which the intake actuator drive body 79 (the exhaust actuator drive body 89) moves. Consequently, even when the intake actuator drive body 79 (the exhaust actuator drive body 89) is moved, the fluid communication port of the high-speed hydraulic liquid supply and discharge channel $90_H$ which is defined in the intake actuator housing 78 (the exhaust actuator housing 88) and open into the inner housing chamber faces the elongate hole 79*h* (the elongate hole 89*h*) in the hollow cylindrical portion at all times, always keeping the high-speed hydraulic liquid supply and discharge channel $90_H$ and the high-speed hydraulic pressure chamber $78_H$ (the high-speed hydraulic pressure chamber 880 in fluid communication with each other.

As shown in FIG. 5, as the intake hydraulic pressure actuator 77 and the exhaust hydraulic pressure actuator 87 are disposed opposite the cam chain compartment 3*c* that houses therein the cam chain 66 for transmitting drive power from the internal combustion engine to the intake camshaft 42 and the exhaust camshaft 52, in the axial directions of the intake camshaft 42 and the exhaust camshaft 52, the intake hydraulic pressure actuator 77 and the exhaust hydraulic pressure actuator 87 are kept out of interference with the cam chain 66, the intake driven gear 47, the exhaust driven gear 57, etc., but disposed in an optimum place where they can easily be installed and which is not obstructed by the cam chain compartment 3*c*.

As depicted in FIG. 5, the intake hydraulic pressure actuator 77 and the exhaust hydraulic pressure actuator 87 are disposed so as to be at least partly superposed on axial extensions of the leftmost two stud bolts 7 of all the stud bolts 7 by which the cylinder block 2 and the cylinder head 3 are stacked on and fastened to the crankcase 1. Consequently, either the intake hydraulic pressure actuator 77 and the exhaust hydraulic pressure actuator 87 or the stud bolts 7 can be placed without largely protruding outward from the cylinder head 3, thus preventing the internal combustion engine E from being large in size.

As FIGS. 4 and 5 show, the exhaust switching drive shaft 81 and the first and second switching pins 83 and 84 in the cylindrical bosses 3Bs are disposed so as to be at least partly superposed on axial extensions of the right four stud bolts 7 on the front side (exhaust side), of all the stud bolts 7 by which the cylinder block 2 and the cylinder head 3 are stacked on and fastened to the crankcase 1. Consequently, either the exhaust switching drive shaft 81 and the first and second switching pins 83 and 84 or the stud bolts 7 can be placed without largely protruding outward from the cylinder head 3, thus preventing the internal combustion engine E from being large in size.

As depicted in FIG. 4, the cylinder head 3, which is separable along the cylinder axes, includes the lower cylinder head member 3L mounted on the cylinder block 2 and the upper cylinder head member 3U mounted on the lower cylinder head member 3L. The intake valve 41 and the exhaust valve 51 are supported on the lower cylinder head member 3L, whereas the intake camshaft 42 and the exhaust camshaft 52 are supported by bearings on the upper cylinder head member 3U. Therefore, the intake camshaft 42, the exhaust camshaft 52, the intake cam switching mechanism 70, and the exhaust cam switching mechanism 80, other than the intake valve 41 and the exhaust valve 51 that are supported on the lower cylinder head member 3L, are provided on the separate upper cylinder head member 3U. The lower cylinder head member 3L and the upper cylinder head member 3U are thus simplified in structure, and can be manufactured with ease.

Although the variable valve operating apparatus according to the embodiment of the present invention has been described above, the present invention is not limited to the above embodiment, but may be reduced to practice according to various embodiments within the scope of the gist of the invention.

According to the present embodiment, one solenoid valve operates two actuators. The present invention is not limited to such a configuration, but two actuators may independently be operated by two solenoid valves.

According to such a modification, the two solenoid valves may be disposed together forwardly of the internal combustion engine or may be disposed individually forwardly and rearwardly of the internal combustion engine.

DESCRIPTION OF REFERENCE SYMBOLS

Pu . . . Power unit, E . . . Internal combustion engine, M . . . Transmission,

1 . . . Crankcase, 2 . . . Cylinder block, 3 . . . Cylinder head, 3L . . . Lower cylinder head member (first cylinder head member), 3U . . . Upper cylinder head member (second cylinder head member), 3Lh . . . Left side wall, 3FL . . . Left end mating surface, 3*v* . . . Bearing wall, 3*c* . . . Cam chain compartment, 4 . . . Cylinder head cover, 5 . . . Oil pan, 7 . . . Stud bolt, 10 . . . Crankshaft, 11 . . . Main shaft, 12 . . . Countershaft, 30 . . . Combustion chamber, 33 . . . Camshaft holder,

40 . . . Variable valve operating apparatus,

41 . . . Intake valve, 42 . . . Intake camshaft, 43 . . . Intake cam carrier, 43A . . . High-speed cam lobe, 43B . . . Low-speed cam lobe, 43D . . . Lead groove tube, 44 . . . Lead groove, 44*c* . . . Annular lead groove, 441 . . . Left shift lead groove, 44*r* . . . Right shift lead groove, 47 . . . Intake driven gear,

51 . . . Exhaust valve, 52 . . . Exhaust camshaft, 53 . . . Exhaust cam carrier, 53A . . . High-speed cam lobe, 53B . . . Low-speed cam lobe, 53D . . . Lead groove tube, 54 . . . Lead groove, 54*c* . . . Annular lead groove, 541 . . . Left shift lead groove, 54*r* . . . Right shift lead groove, 57 . . . Exhaust driven gear, 61 . . . Idle gear, 62 . . . Idle chain sprocket, 66 . . . Cam chain,

70 . . . Intake cam switching mechanism, 71 . . . Intake switching drive shaft, 72 . . . Intake rocker arm, Ca . . . Cam mechanism, 73 . . . First switching pin, 74 . . . Second switching pin, 75 . . . Helical spring, 76 . . . Lid, 77 . . . Intake hydraulic pressure actuator, 78 . . . Intake actuator housing, 79 . . . Intake actuator drive body, 79*h* . . . Elongate hole,

80 . . . Exhaust cam switching mechanism, 81 . . . Exhaust switching drive shaft, 82 . . . Exhaust rocker arm, Cb . . . Cam mechanism, 83 . . . First switching pin, 84 . . . Second switching pin, 86 . . . Lid, 87 . . . Exhaust hydraulic pressure actuator, 88 . . . Exhaust actuator housing, 89 . . . Exhaust actuator drive body, 89*h* . . . Elongate hole, $90_H$ High-speed oil supply and discharge channel, $90_{HH}$ . . . Oblong groove, $90_L$ . . . Low-speed oil supply and discharge channel, $90_{LL}$ . . . Oblong groove,

91 . . . Linear solenoid valve, 92 . . . Electromagnetic solenoid, 92*c* . . . Electromagnetic coil, 92*p* . . . Plunger, 93 . . . Sleeve, 93R . . . Mating surface, $93_I$ . . . Hydraulic pressure supply port, $93_H$ . . . High-speed supply and discharge port, 93L . . . Low-speed supply and discharge port, $93_D$ . . . Drain port, 94 . . . Spool valve, $94_I$ . . . Hydraulic pressure supply groove, $94_D$ . . . Drain groove, 95 . . . Spring,

100 . . . Motorcycle, 101 . . . , 102 . . . Head pipe, 103 . . . Main frame, 104 . . . Seat rail, 105 . . . Front fork,

106 . . . Front wheel, 107 . . . Pivot shaft, 108 . . . Swing arm, 109 . . . Rear wheel, 110 . . . Link mechanism, 111 . . . Rear cushion, 112 . . . Drive sprocket, 113 . . . Driven sprocket, 114 . . . Drive chain, 116 . . . Fuel tank, 117 . . . Main seat, 118 . . . Pillion seat, 121 . . . Throttle body, 122 . . . Air cleaner, 125 . . . Exhaust pipe,

130 . . . Radiator, 131 . . . Radiator fan.

The invention claimed is:

1. A variable valve operating apparatus comprising:

a camshaft rotatably mounted in a cylinder head superposed on a cylinder block of an internal combustion engine, the camshaft being rotatable by drive power transmitted from the internal combustion engine through a cam chain;

a cam carrier in the form a hollow cylindrical member relatively non-rotatably and axially slidably fitted around the camshaft and including, on an outer circumferential surface thereof, a plurality of cam lobes having different cam profiles and disposed axially adjacent to each other; and a cam switching mechanism for axially moving the cam carrier to switch the cam lobes to act on an engine valve;

wherein the cam switching mechanism includes:

a lead groove formed in an outer circumferential surface of the cam carrier and extending fully circumferentially therearound;

a switching pin capable of being advanced to engage in and retracted to disengage from the lead groove;

a first switching drive shaft disposed parallel to the camshaft to be movable longitudinally thereof so as to cooperate with the switching pin to constitute a cam mechanism for advancing and retracting movements of the switching pin, in such a manner that the advancing movement causes the switching pin to engage in the lead groove so as to axially move the cam carrier while rotating, to switch the cam lobes to act on the engine valve; and an actuator for longitudinally moving the switching drive shaft, the actuator including an actuator drive body which is linearly reciprocally movable and is coupled to a longitudinal end of the first switching drive shaft for longitudinally moving the switching drive shaft, the actuator being disposed opposite a cam chain compartment which houses the cam chain therein, in axial directions of the camshaft.

2. The variable valve operating apparatus according to claim 1, wherein the actuator is formed integrally with the cylinder head.

3. The variable valve operating apparatus according to claim 2, wherein the actuator is a hydraulic pressure actuator reciprocally moving the actuator drive body under hydraulic pressure.

4. The variable valve operating apparatus according to claim 2, wherein:

the internal combustion engine includes a crankcase, the cylinder block and the cylinder head integrally fastened to the crankcase by stud bolts oriented in axial directions of a cylinder in the cylinder block; and the actuator is disposed so as to be at least partly superposed on axial extensions of the stud bolts.

5. The variable valve operating apparatus according to claim 1, wherein the actuator is a first hydraulic pressure actuator reciprocally moving the actuator drive body under hydraulic pressure.

6. The variable valve operating apparatus according to claim 5, further including a second switching drive shaft, different from the first switching drive shaft, and a second hydraulic pressure actuator, different from the first hydraulic pressure actuator, each of the first and second switching drive shafts being associated individually with each of the first and second hydraulic pressure actuators.

7. The variable valve operating apparatus according to claim 6, further comprising:

two hydraulic liquid supply and discharge channels for supplying hydraulic liquid to and discharging the hydraulic liquid from one of the first and second hydraulic pressure actuators;

wherein the other of the first and second hydraulic pressure actuators is placed in the hydraulic liquid supply and discharge channels, in such a manner that hydraulic liquid flows through the other of the first and second hydraulic pressure actuators before acting on the one of the first and second hydraulic pressure actuators.

8. The variable valve operating apparatus according to claim 7; wherein:

each of the first and second hydraulic pressure actuators includes an actuator housing having an inner housing chamber, with the actuator drive body being reciprocally slidably fitted therein; and the inner housing chamber is divided into two hydraulic pressure chambers by the actuator drive body, the hydraulic liquid supply and discharge channels being held in fluid communication with each of the two hydraulic pressure chambers.

9. The variable valve operating apparatus according to claim 8, wherein:

the inner housing chamber is defined as a round hole; and the actuator drive body has a bottomed hollow cylindrical shape and includes an elongate hole defined in a hollow cylindrical portion thereof and held in fluid communication with the hydraulic liquid supply and discharge channels, the elongate hole being elongate in directions in which the actuator drive body is movable.

10. The variable valve operating apparatus according to claim 5, wherein:

the internal combustion engine includes a crankcase, the cylinder block and the cylinder head integrally fastened to the crankcase by stud bolts oriented in axial directions of a cylinder in the cylinder block; and the actuator is disposed so as to be at least partly superposed on axial extensions of the stud bolts.

11. The variable valve operating apparatus according to claim 1, wherein:

the internal combustion engine includes a crankcase, the cylinder block and the cylinder head integrally fastened to the crankcase by stud bolts oriented in axial directions of a cylinder in the cylinder block; and the actuator is disposed so as to be at least partly superposed on axial extensions of the stud bolts.

12. The variable valve operating apparatus according to claim 1, wherein:

the internal combustion engine includes a crankcase, the cylinder block and the cylinder head being integrally fastened to the crankcase by stud bolts oriented in axial directions of the cylinder in the cylinder block; and the switching drive shaft and the switching pin are disposed so as to be at least partly superposed on axial extensions of the stud bolts.

13. The variable valve operating apparatus according to claim 1, wherein:

the cylinder head is separable in axial directions of the cylinder in the cylinder block into a first cylinder head member mounted on the cylinder block and a second cylinder head member mounted on the first cylinder head member;

the engine valve is supported on the first cylinder head member; and the camshaft is rotatably supported by bearings on the second cylinder head member.

* * * * *